US011079700B2

(12) United States Patent
Makabe et al.

(10) Patent No.: US 11,079,700 B2
(45) Date of Patent: Aug. 3, 2021

(54) IMAGE FORMING APPARATUS AND IMAGE FORMING METHOD

(71) Applicants: Keiji Makabe, Shizuoka (JP); Tsuneyasu Nagatomo, Shizuoka (JP); Kohsuke Satoh, Shizuoka (JP); Daichi Hisakuni, Shizuoka (JP); Kousuke Suzuki, Shizuoka (JP); Shintaro Akiyama, Shizuoka (JP)

(72) Inventors: Keiji Makabe, Shizuoka (JP); Tsuneyasu Nagatomo, Shizuoka (JP); Kohsuke Satoh, Shizuoka (JP); Daichi Hisakuni, Shizuoka (JP); Kousuke Suzuki, Shizuoka (JP); Shintaro Akiyama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/811,483

(22) Filed: Mar. 6, 2020

(65) Prior Publication Data

US 2020/0301308 A1 Sep. 24, 2020

(30) Foreign Application Priority Data

Mar. 18, 2019 (JP) ..... JP2019-049821

(51) Int. Cl.
*G03G 9/00* (2006.01)
*G03G 15/08* (2006.01)
(Continued)

(52) U.S. Cl.
CPC ..... *G03G 15/08* (2013.01); *G03G 9/0819* (2013.01); *G03G 9/08711* (2013.01);
(Continued)

(58) Field of Classification Search
CPC . G03G 9/09725; G03G 9/09708; G03G 15/08
(Continued)

(56) References Cited

U.S. PATENT DOCUMENTS

2013/0059247 A1 3/2013 Sugimoto et al.
2014/0119769 A1 5/2014 Kikuchi et al.
(Continued)

FOREIGN PATENT DOCUMENTS

JP 52-036016 9/1977
JP 2003-167384 6/2003
(Continued)

OTHER PUBLICATIONS

U.S. Appl. No. 16/569,279, filed Sep. 12, 2019, Minoru Masuda, et al.
(Continued)

*Primary Examiner* — Mark A Chapman
(74) *Attorney, Agent, or Firm* — Oblon, McClelland, Maier & Neustadt, L.L.P.

(57) ABSTRACT

An image forming apparatus is provided that includes: an image bearer; a charger; an irradiator; a developing device containing a toner; and a transfer device. The image bearer has a Martens hardness of from 185 to 250 N/m$^2$. The toner satisfies a relation $0.13 \leq X/Dn \leq 0.16$, where X [μm] represents an average value of an amount of deformation of the toner by micro-indentation at when a load reaches $3.00 \times 10^{-4}$ N at a loading rate of $3.0 \times 10^{-5}$ N/sec under an environment of 32 degrees C. and 40% RH, and Dn [μm] represents a number average particle diameter of the toner. The toner contains an external additive comprising silica particles and particles composed mainly of strontium titanate. The particles composed mainly of strontium titanate further contain a third element M selected from the group consisting of La, Mg, Ca, Sn, and Si.

10 Claims, 4 Drawing Sheets

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/09708* (2013.01); *G03G 9/09716* (2013.01); *G03G 9/09725* (2013.01)

(58) Field of Classification Search
USPC ..... 430/108.6, 108.7
See application file for complete search history.

(56) References Cited

U.S. PATENT DOCUMENTS

| | | | |
|---|---|---|---|
| 2015/0268576 | A1 | 9/2015 | Saito et al. |
| 2016/0266507 | A1 | 9/2016 | Watanabe et al. |
| 2016/0334722 | A1 | 11/2016 | Makabe et al. |
| 2018/0181014 | A1 | 6/2018 | Makabe et al. |
| 2018/0224763 | A1 | 8/2018 | Tanaka et al. |

FOREIGN PATENT DOCUMENTS

| | | |
|---|---|---|
| JP | 2004-309996 | 11/2004 |
| JP | 2006-215532 | 8/2006 |
| JP | 2009-069222 | 4/2009 |
| JP | 2013-054178 | 3/2013 |
| JP | 2013-186167 | 9/2013 |
| JP | 2014-102487 | 6/2014 |
| JP | 2014-238450 | 12/2014 |
| JP | 2017-003916 | 1/2017 |
| JP | 2017-142399 | 8/2017 |
| JP | 2018-020919 | 2/2018 |

OTHER PUBLICATIONS

U.S. Appl. No. 16/583,861, filed Sep. 26, 2019, Yohichi Kitagawa, et al.

Extended European Search Report dated Jul. 31, 2020 in corresponding European Patent Application No. 20160614.2, citing document AA therein, 7 pages.

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-049821, filed on Mar. 18, 2019, in the Japan Patent Office, the entire disclosure of which is hereby incorporated by reference herein.

BACKGROUND

Technical Field

The present disclosure relates to an image forming apparatus and an image forming method.

Description of the Related Art

In a conventional electrophotographic image forming apparatus, a latent image is electrically or magnetically formed and visualized with an electrophotographic toner (hereinafter simply "toner"). For example, in electrophotography, an electrostatic image (latent image) is formed on a photoconductor and developed with a toner to form a toner image. The toner image is typically transferred onto a transfer material such as a paper sheet and fixed thereon. In fixing the toner image on the transfer material, heat fixing methods such as a heat roller fixing method and a heat belt fixing method are widely and generally employed for their high energy efficiency.

In recent years, there has been an increasing demand for high-speed and energy-saving image forming apparatuses. In accordance with this demand, toner that has excellent low-temperature fixability and provides high quality image is required. One approach for achieving low-temperature fixability of toner involves lowering the softening temperature of the binder resin of the toner. However, when the softening temperature of the binder resin is low, a phenomenon called offset (or hot offset) is likely to occur in which a part of the toner image adheres to the surface of a fixing member in the fixing process and then transfers onto a copy sheet. In addition, heat-resistant storage stability of the toner deteriorates. As a result, a phenomenon called blocking occurs in which toner particles fuse with each other particularly in high-temperature environments. Furthermore, another problem may occur such that the toner fuses to the inside of a developing device or to carrier particles to contaminate them or the toner films the surface of the photoconductor.

SUMMARY

In accordance with some embodiments of the present invention, an image forming apparatus is provided. The image forming apparatus includes: an image bearer; a charger configured to charge a surface of the image bearer; an irradiator configured to write an electrostatic latent image on the charged surface of the image bearer; a developing device containing a toner, configured to visualize the electrostatic latent image formed on the surface of the image bearer with the toner to form a toner image; and a transfer device configured to transfer the toner image from the surface of the image bearer onto a transfer medium. The image bearer has a Martens hardness of from 185 to 250 N/mm$^2$. The toner satisfies a relation $0.13 \leq X/Dn \leq 0.16$, where X [μm] represents an average value of an amount of deformation of the toner by micro-indentation at when a load reaches $3.00 \times 10^{-4}$ N at a loading rate of $3.0 \times 10^{-5}$ N/sec under an environment of 32 degrees C. and 40% RH, and Dn [μm] represents a number average particle diameter of the toner. The toner contains an external additive comprising silica particles and particles composed mainly of strontium titanate. The particles composed mainly of strontium titanate further contain a third element M selected from the group consisting of La, Mg, Ca, Sn, and Si.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
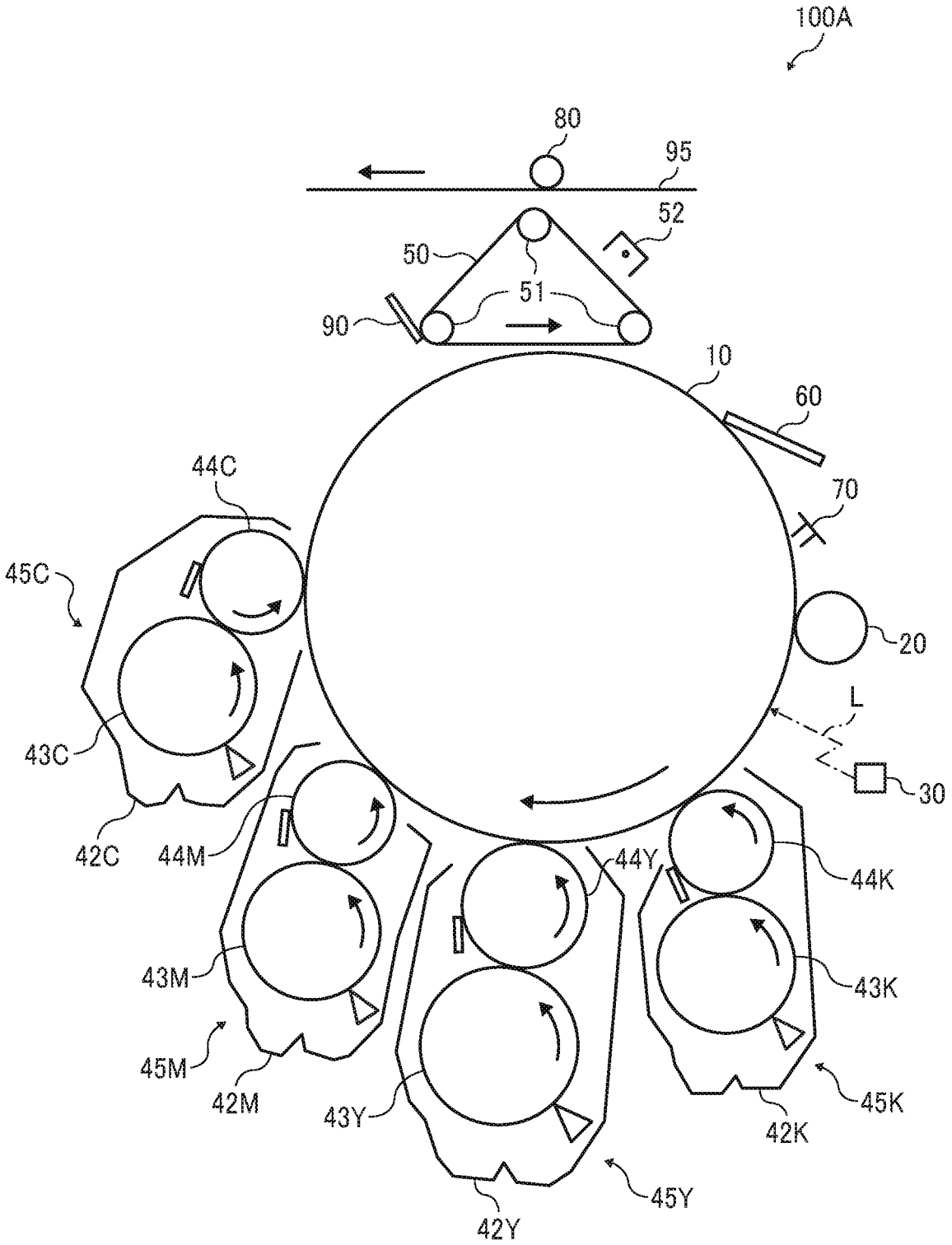
FIG. 1 is a schematic cross-sectional view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In attempting to solve the above-described problems, a large number of toners have been proposed in which a crystalline resin and an amorphous resin are used in combination. Such toners are superior to conventional toners comprising only an amorphous resin in achieving both low-temperature fixability and heat-resistant storage stability. Further, the use of a cross-linked resin having a low softening temperature as a binder resin has been proposed in attempting to achieve both low-temperature fixability and heat-resistant storage stability. However, when these resins are used in large amounts to achieve both low-temperature fixability and heat-resistant storage stability at higher levels, the toner base particles become softer. Accordingly, the amount of inorganic particles used as external additives needs to be increased.

However, as the amount of inorganic particles externally added to the toner increases, the amount of inorganic particles liberated when the toner is developed on the photoconductor increases. The liberated inorganic particles wear the photoconductor while staying at the cleaning blade. An increased amount of the liberated inorganic particles causes the surface layer of the photoconductor to wear more quickly. Thus, there arises a problem of a short lifespan of the photoconductor in contrast to an existing demand for extending the lifespan for reducing load on the global environment.

In view of this situation, a photoconductor having a surface layer containing a cross-linked material and a filler has been proposed in attempting to improve mechanical durability.

On the other hand, it is known that the liberated inorganic particles film the entire photoconductor to cause an abnormal image. It is known that, when inorganic particles film a photoconductor, optical and electrical characteristics of the filmed portion are reduced to cause an abnormal image. This filming phenomenon more significantly occurs as the amount of inorganic particles externally added to the toner is increased.

In attempting to solve the problem of filming of inorganic particles on a photoconductor, the use of an abrasive such as alumina, cerium oxide, and strontium titanate has been proposed.

However, for preventing the occurrence of filming, when an abrasive having a spherical shape such as alumina is added in large amounts, the abrasive action is so strongly exhibited that the wear rate is increased even when the hardness of the surface layer of the photoconductor is high. On the other hand, it has been found that an abrasive having an angular shape such as cerium oxide and strontium titanate has little effect on wear of the photoconductor but easily makes a scratch on the photoconductor due to its shape.

In accordance with some embodiments of the present invention, an image forming apparatus capable of achieving both a higher level of low-temperature fixability of toner and a longer lifespan of an image bearer is provided.

Embodiments of the present invention are described in detail below.

The image forming apparatus according to an embodiment of the present invention satisfies the following configurations.

(a) The image forming apparatus includes: an image bearer; a charger configured to charge a surface of the image bearer; an irradiator configured to write an electrostatic latent image on the charged surface of the image bearer; a developing device containing a toner, configured to visualize the electrostatic latent image formed on the surface of the image bearer with the toner to form a toner image; and a transfer device configured to transfer the toner image from the surface of the image bearer onto a transfer medium.

(b) The image bearer has a Martens hardness of from 185 to 250 $N/mm^2$.

(c) The toner satisfies a relation $0.13 \leq X/Dn \leq 0.16$, where X [μm] represents an average value of an amount of deformation of the toner by micro-indentation at when a load reaches $3.00\times10^{-4}$ N at a loading rate of $3.0\times10^{-5}$ N/sec under an environment of 32 degrees C. and 40% RH, and Dn [μm] represents a number average particle diameter of the toner.

(d) The toner contains an external additive comprising silica particles and particles composed mainly of strontium titanate.

(e) The particles composed mainly of strontium titanate further contains a third element M selected from the group consisting of La, Mg, Ca, Sn, and Si.

According to the configuration (b), the image bearer has a Martens hardness of from 185 to 250 $N/mm^2$. When the Martens hardness of the image bearer is within this range, the wear rate of the image bearer is reduced and the lifespan of the image bearer is extended. Even when the amount of external additive on the image bearer is large, the image bearer is effectively prevented from being scratched, as described in detail later. It is more preferable that the Martens hardness of the image bearer be in the range of from 200 to 250 $N/mm^2$ because the image bearer is more effectively prevented from being scratched.

In the present disclosure, the Martens hardness is measured by the method described in the later-described Examples.

Hereinafter, the image bearer may be referred to as photoconductor.

According to the configuration (c), the toner satisfies a relation $0.13 \leq X/Dn \leq 0.16$, where X [μm] represents an average value of an amount of deformation of the toner by micro-indentation at when a load reaches $3.00\times10^{-4}$ N at a loading rate of $3.0\times10^{-5}$ N/sec under an environment of 32 degrees C. and 40% RH, and Dn [μm] represents a number average particle diameter of the toner.

In a fixing process, the toner is fixed on a paper sheet as a transfer medium by, for example, a fixing roller. The toner is not only softened by heat from the fixing roller but also deformed by a pressure applied in the fixing nip. For this reason, low-temperature fixability of the toner is greatly improved. This is considered to be because the toner is deformed moderately at the fixing nip, so that the contact area between the paper sheet and the toner increases, the contact area between the fixing roller and the toner increases, and the toner can acquire a lager amount of heat.

The amount of deformation by micro-indentation here refers to the amount of deformation of the toner caused by micro-indentation at when a load reaches $3.00\times10^{-4}$ N at a loading rate of $3.0\times10^{-5}$ N/sec under an environment of 32 degrees C. and 40% RH, and represents the ease of deformation of the toner when being fixed under these conditions. The environmental conditions at the micro-indentation of toner are as follows. The temperature is 32 degrees C. that is equal to or lower than the glass transition temperature of the toner, at which the toner starts to be affected by temperature to achieve high sensitivity. An appropriate relative humidity is 40% since the amount of deformation is affected differently by humidity depending on the type of toner. The loading rate and the load are $3.0\times10^{-5}$ N/sec and $3.00\times10^{-4}$ N, respectively, taking into account the time scale in fixing, the pressure applied to the toner in the fixing nip, and stability in measurement. To eliminate the influence of toner particle size on the amount of deformation, a value obtained by dividing the average value X [μm] of the amount of deformation by the number average particle diameter Dn [μm] is used as an index.

When $0.13 \leq X/Dn \leq 0.16$ is satisfied, the toner achieves higher levels of low-temperature fixability and durability against pressure stress at the same time. When X/Dn is smaller than 0.13, the toner hardly deforms due to pressure stress in the developing device to improve durability. However, the toner hardly deforms in the fixing nip to impair low-temperature fixability. By contrast, when X/Dn is larger than 0.16, low-temperature fixability is improved, but durability is impaired even if a large amount of external additives is added to the toner.

To make X/Dn satisfy $0.13 \leq X/Dn \leq 0.16$, physical properties of the binder resin of the toner may be controlled. Physical properties of the binder resins may be controlled by, for example, adjusting the glass transition temperature of an amorphous resin having no cross-linked structure, using an amorphous resin having a cross-linked structure and adjusting the glass transition temperature and content thereof, or using a crystalline resin and adjusting the content thereof. The lower the glass transition temperature of the amorphous resin, the larger the amount of deformation. The larger the content of the crystalline resin, the larger the amount of deformation.

In the present disclosure, when $0.15 \leq X/Dn \leq 0.16$ is satisfied, low-temperature fixability and durability against pressure stress of the toner are more improved.

In the present disclosure, X/Dn is measured by the method described in the later-described Examples.

According to the configuration (d), the toner contains an external additive comprising silica particles and particles composed mainly of strontium titanate. According to the configuration (e), the particles composed mainly of strontium titanate further contains a third element M selected from the group consisting of La, Mg, Ca, Sn, and Si.

The particles composed mainly of strontium titanate here refers to particles containing strontium titanate in an amount of 50% or more in element ratio. Strontium titanate has been conventionally used as an abrasive because of its characteristic hardness (Mohs hardness of 5 to 6) and its angular shape. In the present disclosure, strontium titanate scrapes off silica particles that have been liberated from the toner and adhered to the photoconductor to cause filming.

As the particles composed mainly of strontium titanate contain the third element M, the characteristic angular shape has become a slightly rounded shape. The use of angular-shaped particles free of the third element M causes the photoconductor to be easily scratched, while the use of rounded-shape particles containing the third element M effectively reduces scratches made on the photoconductor.

In the present disclosure, it is preferable that the particles composed mainly of strontium titanate have an average particle diameter of 30 nm or more. Furthermore, it is preferable that, in a projected image of one of the particles, when an arbitrary point on a contour of the particle is defined as a reference point A, another point on the contour of the particle linearly distant from the reference point A for 15 nm in one direction is defined as a point B, another point on the contour of the particle linearly distant from the reference point A for 15 nm in another direction is defined as a point C, and the smallest radius of the circumscribed circle of the triangle formed by the points A, B and C is defined as R, the average value of the smallest radius R be from 11 to 13 nm.

The radius of the circumscribed circle of the triangle is an alternative to the radius of curvature in that area. A smaller radius indicates a steeper curve, and a larger radius indicates a gentler curve. The radius R indicates the degree of steepness at the steepest point in one particle. When the average value of the radius R is from 11 to 13 nm, the degree of steepness is appropriate and most effective. When the average value of the radius R is 11 nm or more, the degree of steepness is not so large, in other words, the shape is not angular, preventing the photoconductor from being scratched. When the average value of the radius R is 13 nm or less, the degree of gentleness of the steep is appropriate and the abrasive action is appropriate, reducing the wear rate of the photoconductor. When the average particle diameter is smaller than 30 nm, the particles tend to be rounded, so that the average value of the radius R exceeds 13 nm. When the average particle diameter is 30 nm or more and the average value of the radius R is from 11 to 13 nm, the wear rate of the photoconductor is reduced, the occurrence of scratch is prevented, and a film of the external additive is effectively scraped off. Further, it is more preferable that, among the particles composed mainly of strontium titanate, those satisfying a condition in which the average value of the smallest radius R is from 11 to 13 nm account for 70% by mass or more of all the particles. Furthermore, it is preferable that the particles composed mainly of strontium titanate have an average particle diameter of from 20 to 150 nm, more preferably from 30 to 70 nm.

In the present disclosure, the radius R is measured by the method described in the later-described Examples.

In the present disclosure, the covering ratio of the toner with the external additive is preferably from 40% to 70%. When the covering ratio is from 40% to 70%, the surface of the toner base particle is sufficiently covered, and the toner becomes more resistant to stress such as pressure and heat. In a case in which the toner base particles contain a crystalline resin or the like in large amounts for exhibiting better low-temperature fixability, durability of the toner is improved when the covering ratio is 40% or more. When the covering ratio is 70% or less, low-temperature fixability of the toner is improved without the external additive inhibiting fixation of the toner. In addition, liberation of the external additive to the photoconductor is reduced, the occurrence of filming is prevented, and wear of the photoconductor is also reduced.

In the present disclosure, when $0.15 \leq X/Dn \leq 0.16$ is satisfied and the covering ratio of the toner with the external additive is from 55% to 70%, low-temperature fixability and durability are more improved.

In the present disclosure, the covering ratio of the toner with the external additive is measured by the method described in the later-described Examples.

In the present disclosure, the above-described configurations (b) to (e) are combined, whereby both a higher level of low-temperature fixability of the toner and a longer lifespan of the photoconductor are achieved. The inventors of the present invention have found that, while the use of particles composed mainly of strontium titanate having an angular shape causes the photoconductor to be scratched, the photoconductor can be prevented from being scratched by changing the shape of the particles to a rounded shape. However, in the case of toner containing a large amount of external additive for achieving high levels of low-temperature fixability and durability, the photoconductor is scratched even when the particles composed mainly of strontium titanate have a rounded shape. This situation is remarkably improved by combining the above configurations (b) to (e). A detailed mechanism has not been cleared yet, but the inventors of the present invention consider as follows.

As the amount of external additive contained in the toner increases, the amount external additive liberated to the photoconductor increases. The liberated external additive accelerates wear of the photoconductor. It is considered that the wear is uneven and fine irregularities on the order of nm are formed. It is assumed that, as the external additive enters a locally recessed portion of the photoconductor, the external additive comes into contact with the photoconductor at many portions, thereby increasing the friction between the external additive and the photoconductor to easily make a scratch. Therefore, when the toner contains a large amount of external additive, a scratch is made on the photoconductor even when particles composed mainly of strontium titanate having a simply rounded shape are used. On the other hand, the present disclosure specifies the Martens hardness of the photoconductor, the amount of deformation of the toner, and the composition of the particles composed mainly of strontium titanate as described above, to reduce local recession of the photoconductor, to prevent the photoconductor from being scratched, to reduce wear of the photoconductor, and to extend the lifespan of the photoconductor. In addition, low-temperature fixability of the toner is achieved at a higher level.

Next, the toner according to an embodiment of the present invention is described in detail below.

Toner Base

The toner base may contain a binder resin, and may further contain other components, as needed.

Binder Resin

The binder resin may include an amorphous resin, and may further include a crystalline resin, as needed.

The amorphous resin is not particularly limited and can be suitably selected to suit to a particular application. Examples thereof include, but are not limited to, acrylic resin, styrene-acrylic resin, polyester resin, and epoxy resin. Among these, polyester resin is preferred. Two or more of these resins can be used in combination, as necessary.

The amorphous polyester resin is not particularly limited and can be suitably selected to suit to a particular application. Examples thereof include, but are not limited to, a polycondensation polyester resin synthesized from a polyol and a polycarboxylic acid.

Preferred examples of the amorphous polyester resin include an amorphous polyester resin comprising a divalent aliphatic alcohol component and a polyvalent aromatic carboxylic acid component as constitutional components.

Examples of the polyol include, but are not limited to, divalent diols and trivalent to octavalent or higher polyols.

The divalent diols are not particularly limited and can be suitably selected to suit to a particular application. Examples thereof include, but are not limited to, divalent aliphatic alcohols such as straight-chain aliphatic alcohols and branched aliphatic alcohols. Among these, aliphatic alcohols having 2 to 36 carbon atoms in the chain are preferred, and straight-chain aliphatic alcohols having 2 to 36 carbon atoms in the chain are more preferred. Each of these materials can be used alone or in combination with others.

The straight-chain aliphatic alcohols are not particularly limited and can be suitably selected to suit to a particular application. Examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, ethylene glycol, 1,3-propanediol (propylene glycol), 1,4-butanediol, 1,6-hexanediol, 1,9-nonanediol, and 1,10-decanediol are preferred for their availability. Among these, straight-chain aliphatic alcohols having 2 to 36 carbon atoms in the chain are preferred.

Examples of the polycarboxylic acid include, but are not limited to, dicarboxylic acids and trivalent to hexavalent or higher polycarboxylic acids. Among these, polyvalent aromatic carboxylic acids are preferred.

The dicarboxylic acids are not particularly limited and can be suitably selected to suit to a particular application. Examples thereof include, but are not limited to, aliphatic dicarboxylic acids and aromatic dicarboxylic acids. Examples of the aliphatic dicarboxylic acids include, but are not limited to, straight-chain aliphatic dicarboxylic acids and branched aliphatic dicarboxylic acids. Among these, straight-chain aliphatic dicarboxylic acids are preferred.

The aliphatic dicarboxylic acids are not particularly limited and can be suitably selected to suit to a particular application. Examples thereof include, but are not limited to, alkanedicarboxylic acids, alkenyl succinic acids, alkenedicarboxylic acids, and alicyclic dicarboxylic acids.

Examples of the alkanedicarboxylic acids include, but are not limited to, alkanedicarboxylic acids having 4 to 36 carbon atoms. Examples of the alkanedicarboxylic acid having 4 to 36 carbon atoms include, but are not limited to, succinic acid, adipic acid, sebacic acid, azelaic acid, dodecanedicarboxylic acid, octadecanedicarboxylic acid, and decyl succinic acid.

Examples of the alkenyl succinic acids include, but are not limited to, dodecenyl succinic acid, pentadecenyl succinic acid, and octadecenyl succinic acid.

Examples of the alkenedicarboxylic acids include, but are not limited to, alkenedicarboxylic acids having 4 to 36 carbon atoms. Examples of the alkenedicarboxylic acids having 4 to 36 carbon atoms include, but are not limited to, maleic acid, fumaric acid, and citraconic acid.

Examples of the alicyclic dicarboxylic acids include, but are not limited to, alicyclic dicarboxylic acids having 6 to 40 carbon atoms. Examples of the alicyclic dicarboxylic acids having 6 to 40 carbon atoms include, but are not limited to, dimer acid (dimerized linoleic acid).

The aromatic dicarboxylic acids are not particularly limited and can be suitably selected to suit to a particular application. Examples thereof include, but are not limited to, aromatic dicarboxylic acids having 8 to 36 carbon atoms. Examples of the aromatic dicarboxylic acids having 8 to 36 carbon atoms include, but are not limited to, phthalic acid, isophthalic acid, terephthalic acid, t-butylisophthalic acid, 2,6-naphthalenedicarboxylic acid, and 4,4'-biphenyl dicarboxylic acid.

Examples of the trivalent to hexavalent or higher polycarboxylic acids include, but are not limited to, aromatic polycarboxylic acids having 9 to 20 carbon atoms. Examples of the aromatic polycarboxylic acids having 9 to 20 carbon atoms include, but are not limited to, trimellitic acid and pyromellitic acid.

In addition, acid anhydrides and C1-C4 alkyl esters of the above-described compounds may be used as the dicarboxylic acids or the trivalent to hexavalent or higher polycarboxylic acids. Examples of the C1-C4 alkyl esters include, but are not limited to, methyl ester, ethyl ester, and isopropyl ester.

The amorphous polyester resin has a weight average molecular weight of from 3,000 to 10,000, preferably from 4,000 to 7,000. When the weight average molecular weight of the amorphous polyester resin is 3,000 or more, heat-resistant storage stability and durability of the toner are improved. When it is 10,000 or less, low-temperature fixability of the toner is improved.

The amorphous polyester resin has an acid value of from 1 to 50 mgKOH/g, preferably from 5 to 30 mgKOH/g. When the acid value of the amorphous polyester resin is 1 mgKOH/g or more, the toner is negatively chargeable and low-temperature fixability of the toner is improved. When it is 50 mgKOH/g or less, charge stability of the toner, particularly charge stability with respect to environmental changes, is improved.

The amorphous polyester resin has a hydroxyl value of 5 mgKOH/g or more.

The amorphous polyester resin has a glass transition temperature of from 40 to 80 degrees C., preferably from 50 to 70 degrees C. When the glass transition temperature of the amorphous polyester resin is 40 degrees C. or higher, heat-resistant storage stability, durability, and filming resistance of the toner are improved. When it is 80 degrees C. or lower, low-temperature fixability of the toner is improved.

The proportion of the amorphous polyester resin in the toner is 50% by mass or more, preferably from 50% to 90% by mass, and more preferably from 60% to 80% by mass. When the proportion of the amorphous polyester resin in the toner is 50% by mass or more, fogging and disturbance of an image are prevented. When it is 90% by mass or less, low-temperature fixability of the toner is improved.

The crystalline resin is not particularly limited and can be suitably selected to suit to a particular application. Examples thereof include, but are not limited to, acrylic resin, styrene-acrylic resin, polyester resin, and epoxy resin. Among these, polyester resin is preferred.

The crystalline polyester resin exhibits, due to its high crystallinity, a heat melting property such that the viscosity sharply drops at around the fixing start temperature. Therefore, the crystalline polyester resin never starts melting until the temperature reaches the melting start temperature, thereby providing excellent heat-resistant storage stability. At the melting start temperature, the crystalline polyester resin melts and the viscosity thereof sharply drops. As a result, the crystalline polyester resin gets compatibilized with the amorphous resin and the toner gets fixed. Thus, the toner exhibits excellent heat-resistant storage stability and low-temperature fixability. In addition, the toner exhibits a wide releasable temperature range, i.e., a large difference between the lowest fixable temperature and the high-temperature offset generating temperature.

The crystalline polyester resin is not particularly limited and can be suitably selected to suit to a particular application. Examples thereof include, but are not limited to, a polycondensation polyester resin synthesized from a polyol and a polycarboxylic acid.

In addition, anhydrides, C1-C3 lower alkyl esters, and halides of the polycarboxylic acid may be used in place of the polycarboxylic acid.

Examples of the polyol include, but are not limited to, diols and trivalent or higher alcohols. Two or more of these can be used in combination.

Examples of the diols include, but are not limited to, saturated aliphatic diols.

Examples of the saturated aliphatic diols include, but are not limited to, straight-chain saturated aliphatic diols and branched saturated aliphatic diols. Among these, straight-chain saturated aliphatic diols are preferred for increasing crystallinity of the crystalline polyester resin, and straight-chain saturated aliphatic diols having 2 to 12 carbon atoms are more preferred for their availability.

Examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, ethylene glycol, 1,4-butanediol, 1,6-hexanediol, 1,8-octanediol, 1,10-decanediol, and 1,12-dodecanediol are preferred for giving high crystallinity and excellent sharply-melting property to the crystalline polyester resin.

Examples of the trivalent or higher alcohols include, but are not limited to, glycerin, trimethylolethane, trimethylolpropane, and pentaerythritol.

The polycarboxylic acid is not particularly limited. Examples thereof include, but are not limited to, divalent carboxylic acids and trivalent or higher carboxylic acids.

Examples of the divalent carboxylic acids include, but are not limited to, saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids such as diprotic acids such as phthalic acid, isophthalic acid, terephthalic acid, naphthalene-2,6-dicarboxylic acid, malonic acid, and mesaconic acid.

Examples of the trivalent or higher carboxylic acids include, but are not limited to, 1,2,4-benzenetricarboxylic acid, 1,2,5-benzenetricarboxylic acid, and 1,2,4-naphthalenetricarboxylic acid.

The polycarboxylic acid may include a dicarboxylic acid having a sulfonate group.

The polycarboxylic acid may include a dicarboxylic acid having carbon-carbon double bond.

Preferably, the crystalline polyester resin has a structural unit derived from a straight-chain saturated aliphatic dicarboxylic acid having 4 to 12 carbon atoms and another structural unit derived from a straight-chain saturated aliphatic diol having 2 to 12 carbon atoms. Such a crystalline polyester resin has high crystallinity and sharply-melting property. As a result, low-temperature fixability of the toner is improved.

The crystalline polyester resin has a weight average molecular weight of from 3,000 to 30,000, preferably from 5,000 to 15,000. When the weight average molecular weight of the crystalline polyester resin is 3,000 or more, heat-resistant storage stability of the toner is improved. When it is 30,000 or less, low-temperature fixability of the toner is improved.

The crystalline polyester resin has an acid value of 5 mgKOH/g or more, preferably 10 mgKOH/g or more. In this case, low-temperature fixability of the toner is improved. In addition, the crystalline polyester resin has an acid value of 45 mgKOH/g or less. In this case, high-temperature offset resistance of the toner is improved.

The crystalline polyester resin has a hydroxyl value of 50 mgKOH/g or less, preferably from 5 to 50 mgKOH/g. When the hydroxyl value of the crystalline polyester resin is 50 mgKOH/g or less, low-temperature fixability and chargeability of the toner are improved.

The crystalline polyester resin has a melting point of from 60 to 90 degrees C., preferably from 60 to 80 degrees C. When the melting point of the crystalline polyester resin is 60 degrees C. or higher, heat-resistant storage stability of the toner is improved. When it is 90 degrees C. or lower, low-temperature fixability of the toner is improved.

The molecular structure of the crystalline polyester resin can be determined by solution or solid NMR (nuclear magnetic resonance), X-ray diffractometry, GC/MS (gas chromatography-mass spectroscopy), LC/MS (liquid chromatography-mass spectroscopy), IR (infrared spectroscopy), or the like. Conveniently, in an infrared absorption spectrum, the crystalline polyester is detected as a substance showing an absorption based on 6CH (out-of-plane bending vibration) of olefin at 965±10 $cm^{-1}$ or 990±10 $cm^{-1}$.

The proportion of the crystalline polyester resin in the toner is from 3% to 15% by mass, preferably from 5% to 10% by mass. When the proportion of the crystalline polyester resin in the toner is 3% by mass or more, low-temperature fixability of the toner is improved. When it is 15% by mass of less, heat-resistant storage stability of the toner is improved and the occurrence of image fogging is prevented.

Examples of the other components contained in the toner base include, but are not limited to, a release agent, a colorant, a charge controlling agent, a cleanability improving agent, and a magnetic material.

Specific examples of the release agent include, but are not limited to, plant waxes (e.g., carnauba wax, cotton wax, sumac wax, rice wax), animal waxes (e.g., beeswax, lanolin), mineral waxes (e.g., ozokerite, ceresin), petroleum waxes (e.g., paraffin, micro-crystalline wax, petrolatum), hydrocarbon waxes (e.g., Fischer-Tropsch wax, polyethylene wax, polypropylene wax), synthetic waxes (e.g., ester, ketone, ether), and fatty acid amide compounds (e.g., 12-hydroxystearic acid amide, stearic acid amide, phthalic anhydride imide). Among these, hydrocarbon waxes such as paraffin wax, micro-crystalline wax, Fischer-Tropsch wax, polyethylene wax, and polypropylene wax are preferred.

The release agent has a melting point of from 60 to 80 degrees C. When the melting point of the release agent is 60 degrees C. or higher, heat-resistant storage stability of the toner is improved. When it is 80 degrees C. or lower, high-temperature offset resistance of the toner is improved.

The proportion of the release agent in the toner is from 2% to 10% by mass, preferably from 3% to 8% by mass. When the proportion of the release agent in the toner is 2% by mass or more, high-temperature offset resistance and low-temperature fixability of the toner are improved. When it is 10% by mass of less, heat-resistant storage stability of the toner is improved and the occurrence of image fogging is prevented.

Specific examples of the colorant include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perinone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The proportion of the colorant in the toner is from 1% to 15% by mass, preferably from 3% to 10% by mass.

The colorant can be combined with a resin to be used as a master batch.

Examples of the resin include, but are not limited to, amorphous polyester resins, polymers of styrene or substitutes thereof, such as polystyrene, poly p-chlorostyrene, and polyvinyl toluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid, rosin, modified rosin, terpene resins, aliphatic or alicyclic hydrocarbon resins, and aromatic petroleum resins. Two or more of these resins may be used in combination.

The master batch can be obtained by mixing and kneading the resin and the colorant. To increase the interaction between the colorant and the resin, an organic solvent may be used.

More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried.

The mixing and kneading may be performed by a high shearing dispersing device such as a three-roll mill.

Examples of the cleanability improving agent include, but are not limited to, metal salts of fatty acids (e.g., zinc stearate, calcium stearate) and polymer particles prepared by soap-free emulsion polymerization (e.g., polymethyl methacrylate particles, polystyrene particles).

The polymer particles have a volume average particle diameter of from 0.01 to 1 μm.

Examples of the magnetic material include, but are not limited to, iron, magnetite, and ferrite. Among these materials, those having white color are preferred in terms of color tone.

External Additive

In the present disclosure, the toner contains an external additive comprising silica particles and particles composed mainly of strontium titanate. The toner may further contain another external additive in combination with the above-described external additive. For example, oxide particles (e.g., titania particles, tin oxide particles, antimony oxide particles), metal salts of fatty acids (e.g., zinc stearate, aluminum stearate), and fluoropolymer particles are suitably used. For hydrophobization, it is preferable that the surfaces of the particles be coated with an organic compound, as described below.

A method for producing the particles composed mainly of strontium titanate is not particularly limited as long as the characteristics required in the present disclosure are achieved. Examples thereof include, but are not limited to, a hydrothermal treatment method using a pressurized container and a normal pressure heating reaction method.

In the normal pressure heating reaction method, first, a mineral acid peptized product of a hydrolysate of a titanium compound, a water-soluble compound containing strontium, and a water-soluble compound of a third component M selected from La, Mg, Ca, Sn and Si are mixed to prepare a mixture liquid in which the proportion of the third component M to strontium is about 2% to 15% by mol. The mixture liquid is heated to from 70 to 100 degrees C. while adding an alkaline aqueous solution thereto, thus producing particles composed mainly of strontium titanate. The particles composed mainly of strontium titanate are then treated with an acid.

In the normal pressure heating reaction method, inorganic acid peptized products of titanium compounds can be used as the source of titanium oxide, and strontium nitrate, strontium chloride, strontium hydroxide, or the like can be used as the source of strontium. Preferred examples of the water-soluble compound of the third component M include, but are not limited to, lanthanum nitrate, lanthanum chloride, lanthanum hydroxide, magnesium nitrate, magnesium chloride, magnesium hydroxide, calcium nitrate, calcium chloride, calcium hydroxide, tin chloride, sodium stannate, and sodium silicate. As the alkaline aqueous solution, caustic alkali can be used, and a sodium hydroxide aqueous solution is particularly preferred.

In the above-described production method, the particle size of the resulting particles composed mainly of strontium titanate is influenced by the mixing ratio of raw materials during the reaction, the concentration of titanium oxide source in the initial stage of the reaction, the temperature and addition rate at the addition of the alkaline aqueous solution, or the like. Further, the shape of the particles composed mainly of strontium titanate, e.g., the radius R thereof, is influenced by the amount of addition of the third component M, which can be appropriately adjusted to obtain particles with targeted particle size and shape. To prevent generation of strontium carbonate in the reaction process, it is preferable to prevent immixing of carbon dioxide gas by, for example, performing the reaction in a nitrogen gas atmosphere.

A method for hydrophobizing the silica particles or particles composed mainly of strontium titanate is not particularly limited. Examples thereof include a method of coating their surfaces with an organic compound, such as a method of treating the particles with a silane coupling agent and a method of treating the particles with silicone oil. Two or more treatment agents may be used in combination, or two or more treatment methods may be used in combination.

Examples of the silane coupling agent include, but are not limited to, hexamethyldisilazane, methyl trimethoxysilane, methyl triethoxysilane, and octyl trimethoxysilane.

Examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacrylic-modified silicone oil, and α-methylstyrene-modified silicone oil.

The proportion of the external additive in the toner is from 0.5% to 8% by mass, and to achieve both low-temperature fixability and durability at high levels, the proportion is preferably from 3% to 6% by mass.

The proportion of the silica particles as the external additive in the toner is preferably from 1.5% to 5% by mass. The proportion of the particles composed mainly of strontium titanate as the external additive in the toner is preferably from 0.05% to 2% by mass.

The silica particles or particles composed mainly of strontium titanate have an average primary particle diameter of from 10 to 500 nm, preferably from 20 to 100 nm.

When the average primary particle diameter of the silica particles or particles composed mainly of strontium titanate is 10 nm or more, the particles are prevented from being embedded in the base particles. When it is 500 nm or less, the particles are prevented from liberating from the toner.

A method for producing the toner base particles is not particularly limited. Examples thereof include an ester elongation method.

Preferably, the toner is produced by emulsifying or dispersing an oil phase containing an amorphous prepolymer having an isocyanate group and an amorphous polyester resin, and optionally a crystalline polyester resin, a release agent, a colorant, and the like, in an aqueous medium.

Preferably, the toner is produced by emulsifying or dispersing an oil phase containing an amorphous polyester prepolymer A having an isocyanate group and an amorphous polyester resin B, and optionally a crystalline polyester resin C, a release agent, a colorant, and the like, in an aqueous medium.

Preferably, in the aqueous medium, resin particles are dispersed.

The resin constituting the resin particles is not particularly limited as long as the resin is capable of being dispersed in the aqueous medium. Examples of such a resin include, but are not limited to, vinyl resin, polyurethane, epoxy resin, polyester, polyamide, polyimide, silicone-based resin, phenol resin, melamine resin, urea resin, aniline resin, ionomer resin, and polycarbonate. Two or more of these resins can be used in combination. Among these resins, vinyl resin, polyurethane, epoxy resin, and polyester are preferred because fine spherical particles thereof are easily obtainable.

The mass ratio of the resin particles to the aqueous medium is from 0.005 to 0.1.

Examples of the aqueous medium include, but are not limited to, water and water-miscible solvents. Two or more of them may be used in combination. Among these, water is preferable.

Examples of the water-miscible solvents include, but are not limited to, alcohols, dimethylformamide, tetrahydrofuran, cellosolves, and lower ketones.

Examples of the alcohols include, but are not limited to, methanol, isopropanol, and ethylene glycol.

Examples of the lower ketones include, but are not limited to, acetone and methyl ethyl ketone.

The oil phase may be prepared by dissolving or dispersing toner materials including the amorphous polyester prepolymer A having an isocyanate group and the amorphous polyester resin B, and optionally the crystalline polyester resin C, the release agent, the colorant, and the like, in an organic solvent.

The organic solvent has a boiling point of lower than 150 degrees C. Thus, the organic solvent can be easily removed.

Examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these, ethyl acetate, toluene, xylene, benzene, methylene chloride, 1,2-dichloroethane, chloroform, and carbon tetrachloride are preferred, and ethyl acetate is most preferred.

When the oil phase is emulsified or dispersed in the aqueous medium, the amorphous polyester prepolymer A having an isocyanate group is allowed to react with a compound having an active hydrogen group to produce an amorphous polyester resin A.

The amorphous polyester resin A may be produced by one of the following procedures (1) to (3).

(1) Emulsify or disperse an oil phase containing the amorphous prepolymer A having an isocyanate group and the compound having an active hydrogen group in an aqueous medium, to cause an elongation reaction and/or a cross-linking reaction between the compound having an active hydrogen group and the amorphous prepolymer A having an isocyanate group in the aqueous medium, thereby forming the amorphous polyester resin A.

(2) Emulsify or disperse an oil phase containing the amorphous prepolymer A having an isocyanate group in an aqueous medium to which the compound having an active hydrogen group has been previously added, to cause an elongation reaction and/or a cross-linking reaction between the compound having an active hydrogen group and the amorphous prepolymer A having an isocyanate group in the aqueous medium, thereby forming the amorphous polyester resin A.

(3) Emulsify or disperse an oil phase containing the amorphous prepolymer A having an isocyanate group in an aqueous medium and thereafter add the compound having an active hydrogen group to the aqueous medium, to cause an elongation reaction and/or a cross-linking reaction between the compound having an active hydrogen group and the amorphous prepolymer A having an isocyanate group in the aqueous medium from the interfaces of dispersed particles, thereby forming the amorphous polyester resin A.

In a case in which an elongation reaction and/or a cross-linking reaction between the compound having an active hydrogen group and the amorphous polyester prepolymer A having an isocyanate group is caused from the interfaces of the dispersed particles, the amorphous polyester is preferentially formed at the surface of the resulting toner while forming a concentration gradient of the amorphous polyester inside the toner.

The time for reacting the compound having an active hydrogen group with the amorphous polyester prepolymer A having an isocyanate group is from 10 minutes to 40 hours, preferably from 2 to 24 hours.

The temperature at which the compound having an active hydrogen group reacts with the amorphous polyester prepolymer A having an isocyanate group is from 0 to 150 degrees C., preferably from 40 to 98 degrees C.

When the compound having an active hydrogen group is allowed to react with the amorphous polyester prepolymer A having an isocyanate group, a catalyst may be used.

Examples of the catalyst include, but are not limited to, dibutyltin laurate and dioctyltin laurate.

A method for emulsifying or dispersing the oil phase in the aqueous medium is not particularly limited. Examples thereof include a method including adding the oil phase in the aqueous medium and dispersing with a shearing force.

A disperser for emulsifying or dispersing the oil phase in the aqueous medium is not particularly limited. Examples thereof include low-speed shearing dispersers, high-speed shearing dispersers, friction dispersers, high-pressure jet dispersers, and ultrasonic dispersers.

Among these dispersers, high-speed shearing dispersers are preferred because they can adjust the particle size of the dispersoids (oil droplets) to 2 to 20 μm.

When a high-speed shearing disperser is used, the revolution is from 1,000 to 30,000 rpm, preferably from 5,000 to 20,000 rpm. The dispersing time for a batch disperser is from 0.1 to 5 minutes. The dispersing temperature is from 0 to 150 degrees C., preferably from 40 to 98 degrees C., under pressure.

The mass ratio of the aqueous medium to the toner materials is from 0.5 to 20, preferably from 1 to 10. When the mass ratio of the aqueous medium to the toner materials is 0.5 or more, the oil phase can be well dispersed. When it is 20 or less, it is economical.

Preferably, the aqueous medium contains a dispersant. In this case, at the time when the oil phase is emulsified or dispersed in the aqueous medium, dispersion stability of oil droplets is improved, thereby forming base particles having a desired shape and narrowing the particle size distribution.

Examples of the dispersant include, but are not limited to, surfactants, poorly-water-soluble inorganic compound dispersants, and polymeric protection colloids. Two or more of these dispersants can be used in combination. Among these, surfactants are preferred.

Examples of the surfactants include, but are not limited to, anionic surfactants, cationic surfactants, nonionic surfactants, and ampholytic surfactants. Among these, surfactants having a fluoroalkyl group are preferred.

Examples of the anionic surfactants include, but are not limited to, alkylbenzene sulfonate, α-olefin sulfonate, and phosphate.

Preferably, base particles are formed by removing the organic solvent after the oil phase has been dispersed in the aqueous medium.

A method for removing the organic solvent is not particularly limited. Examples thereof include a method of gradually raising the temperature of the aqueous medium in which the oil phase is dispersed to completely evaporate the organic solvent from oil droplets, and a method of spraying the aqueous medium in which the oil phase is dispersed into dry atmosphere to completely evaporate the organic solvent from oil droplets.

Preferably, the base particles are dried after being washed. At this time, the base particles may also be classified. Specifically, the classification may be performed by removing ultrafine particles from the base particles contained in the aqueous medium by cyclone, decantation, or centrifuge. Alternatively, the classification may be performed after the base particles have been dried.

The base particles are then mixed with the external additive and optionally with a charge controlling agent, thus preparing a toner. At this time, a mechanical impact force may be applied to the mixture to prevent the external additive from liberating from the surface of the base particles.

A method for applying the mechanical impact force to the mixture is not particularly limited. Examples thereof include a method of rotating blades at a high speed to apply an impact force to the mixture, and a method of putting the mixture in a high-speed airflow to allow the particles collide with each other or with a collision plate to apply an impact force to the mixture.

The mechanical impact force may be applied to the mixture by using commercially-available products such as ONG MILL (available from Hosokawa Micron Corporation), I-TYPE MILL (available from Nippon Pneumatic Mfg. Co., Ltd.) modified to reduce the pulverizing air pressure, HYBRIDIZATION SYSTEM (available from Nara Machinery Co., Ltd.), and KRYPTON SYSTEM (available from Kawasaki Heavy Industries, Ltd.).

A developer according to an embodiment of the present invention contains the above-described toner and optionally other components such as a carrier.

The developer may be either a one-component developer or a two-component developer.

The carrier comprises a core material and a protective layer formed thereon.

The material constituting the core material is not particularly limited. Examples thereof include high-magnetization materials such as manganese-strontium materials having a mass magnetization of from 50 to 90 emu/g, manganese-magnesium materials having a mass magnetization of from 50 to 90 emu/g, iron having a mass magnetization of 100 emu/g or more, and magnetite having a mass magnetization of from 75 to 120 emu/g; and low-magnetization materials such as copper-zinc materials having a mass magnetization of from 30 to 80 emu/g. Two or more of these materials can be used in combination.

The core material has a volume average particle diameter of from 10 to 150 am, more preferably from 40 to 100 μm.

The proportion of the carrier in the two-component developer is from 90% to 98% by mass, more preferably from 93% to 97% by mass.

The developer is used stored in a container.

The container is not particularly limited. Examples thereof include a container having a container body and a cap.

The shape of the container body is not particularly limited and may be a cylindrical shape.

Preferably, on the inner circumferential surface of the container body, projections and recesses are formed in a spiral manner, so that the developer can move to the discharge port side as the container body rotates. More preferably, part or all of the projections and recesses formed in a spiral manner have a bellows function.

The material of the container body is not particularly limited. Examples thereof include a resin such as polyester, polyethylene, polypropylene, polystyrene, polyvinyl chloride, polyacrylic acid, polycarbonate, ABS resin, and polyacetal.

The container storing the developer is easy to preserve, transport, and handle. Therefore, the container is detachably mountable on a process cartridge or an image forming apparatus (to be described later) to supply the developer thereto.

The developer can be used for known image forming apparatuses and process cartridges that form image by electrophotography, such as magnetic one-component developing methods, non-magnetic one-component developing methods, and two-component developing methods.

The photoconductor used in the present disclosure includes at least a conductive substrate and a photosensitive layer disposed on the conductive substrate and optionally other structures as necessary.

Conductive Substrate

The conductive substrate is not particularly limited and can be suitably selected to suit to a particular application as long as it has a volume resistivity of $10^{10}$ Ω·cm or less. An endless belt (e.g., endless nickel belt, endless stainless-steel belt) disclosed in Examined Japanese Patent Publication No. 52-36016 may also be used.

Photosensitive Layer

The photosensitive layer is not particularly limited and can be suitably selected to suit to a particular application as long as it has a surface layer on its outermost surface. Preferably, the photosensitive layer has at least a charge generation layer, a charge transport layer, and the surface layer (cross-linked charge transport layer) in this order, and other layers as necessary.

Charge Generation Layer

The charge generation layer includes a charge generation material having a charge generation function as a main component, and optionally includes a binder resin as necessary. The charge generation material may be either an inorganic material or an organic material.

Examples of the inorganic material include, but are not limited to, crystalline selenium, amorphous selenium, selenium-tellurium, selenium-tellurium-halogen, selenium-arsenic compounds, and amorphous silicon. Preferred examples of the amorphous silicon include those obtained by terminating dangling bonds with hydrogen atoms or halogen atoms, and those doped with boron atoms, phosphorus atoms, or the like.

Examples of the organic material include known materials. Examples thereof include, but are not limited to, phthalocyanine pigments such as metal phthalocyanine and metal-free phthalocyanine, azulenium salt pigments, squaric acid methine pigments, azo pigments having a carbazole backbone, azo pigments having a triarylamine backbone, azo pigments having a diphenylamine backbone, azo pigments having a dibenzothiophene backbone, azo pigments having a fluorenone backbone, azo pigments having an oxadiazole backbone, azo pigments having a bisstilbene backbone, azo pigments having a distyryl oxadiazole backbone, azo pigments having a distyryl carbazole backbone, perylene pigments, anthraquinone or polycyclic quinone pigments, quinone imine pigments, diphenylmethane and triphenylmethane pigments, benzoquinone and naphthoquinone pigments, cyanine and azomethine pigments, indigoid pigments, and bisbenzimidazole pigments. Each of these charge generation materials can be used alone or in combination with others.

Charge Transport Layer

The charge transport layer has a charge transport function and contains a charge transport material or polymer charge transport material and a binder resin as main components.

The charge transport material is not particularly limited and can be suitably selected to suit to a particular application. Examples thereof include, but are not limited to, known hole transport materials having a hole transport structure such as triarylamine, hydrazone, pyrazoline, and carbazole, and known electron transport materials having an electron transport structure such as an electron withdrawing aromatic ring having a condensed polycyclic quinone, diphenoquinone, cyano group, or nitro group. Each of these hole transport materials or electron transport materials may be used alone or in combination with others.

Surface Layer

The surface layer may contain a filler and a binder resin.

Examples of the binder resin include thermoplastic resins such as polyarylate resin and polycarbonate resin, and cross-linked resins such as urethane resin and phenol resin.

Examples of the filler include organic particles and inorganic particles, and inorganic particles are preferred.

Examples of the organic particles include, but are not limited to, fluorine-containing resin particles and carbon-based particles.

Examples of the inorganic particles include, but are not limited to, powders of metals such as copper, tin, aluminum, and indium. Examples of the inorganic particles further include metal oxides such as silicon oxide, silica, tin oxide, zinc oxide, titanium oxide, indium oxide, antimony oxide, bismuth oxide, antimony-doped tin oxide, and tin-doped indium oxide, and inorganic materials such as potassium titanate. In particular, metal oxides are preferred. Furthermore, silicon oxide, aluminum oxide, and titanium oxide can be effectively used.

Preferably, the inorganic particles have a volume average particle diameter of from 10 to 500 nm for light transmittance and wear resistance of the surface layer.

When the volume average particle diameter of the inorganic particles is 10 nm or more, deterioration of wear resistance and deterioration of dispersibility are prevented. When it is 500 nm or less, precipitation of the inorganic particles in a dispersion liquid is prevented.

The volume average particle diameter can be measured by a laser diffraction particle size distribution analyzer LA-920 (available from HORIBA, Ltd.).

The higher the concentration of the inorganic particles in the surface layer, the higher the wear resistance. However, when the concentration is too high, residual potential is increased and writing light transmittance of the outermost layer is lowered, which may cause side effects. Therefore, the concentration of the inorganic particles is generally 50% by weight or less, preferably 30% by weight or less, based on the total solid contents. The lower limit thereof is 5% by weight.

The image forming apparatus according to an embodiment of the present invention includes: an image bearer; a charger configured to charge a surface of the image bearer; an irradiator configured to write an electrostatic latent image on the charged surface of the image bearer; a developing device containing a toner, configured to visualize the electrostatic latent image formed on the surface of the image bearer with the toner to form a toner image; and a transfer device configured to transfer the toner image from the surface of the image bearer onto a transfer medium.

The image forming method according to an embodiment of the present invention includes: a charging step for charging a surface of the image bearer; an irradiating step for writing an electrostatic latent image on the charged surface of the image bearer; a developing step for visualizing the electrostatic latent image formed on the surface of the image bearer with a toner to form a toner image; and a transfer step for transferring the toner image from the surface of the image bearer onto a transfer medium.

The above apparatus and method according to some embodiments of the present invention are described below with reference to an image forming apparatus illustrated in FIG. 1.

An image forming apparatus 100A illustrated in FIG. 1 includes a photoconductor drum 10 serving as an electrostatic latent image bearer, a charging roller 20 serving as a charger, an irradiator 30, developing devices 45K, 45Y, 45M and 45C (collectively "developing devices 45"), an intermediate transfer medium 50, a cleaner 60 having a cleaning blade, and a neutralization lamp 70 serving as a neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 1. A part of the three rollers 51 also functions as a transfer bias roller for applying a predetermined transfer bias (primary transfer bias) to the intermediate transfer medium 50.

In the vicinity of the intermediate transfer medium 50, a cleaner 90 equipped with a cleaning blade is disposed. A transfer roller 80 capable of applying a transfer bias to a recoding sheet 95, for secondarily transferring a toner image thereon, is disposed facing the intermediate transfer medium 50.

Around the intermediate transfer medium 50, a corona charger 52 that gives charge to the toner image on the intermediate transfer medium 50 is disposed between a contact portion of the intermediate transfer medium 50 with the photoconductor drum 10 and another contact portion of the intermediate transfer medium 50 with the recoding sheet 95.

The developing devices 45K, 45Y, 45M, and 45C, for respectively developing black, yellow, magenta, and cyan images, include respective developer containers 42K, 42Y, 42M, and 42C, respective developer supply rollers 43K, 43Y, 43M, and 43C, and respective developing rollers 44K, 44Y, 44M, and 44C.

In the image forming apparatus 100A, first, the charging roller 20 uniformly charges the photoconductor drum 10, and the irradiator 30 emits light L containing image information to the photoconductor drum 10, thus forming an electrostatic latent image. Next, each of the developing devices 45 supplies the developer to the electrostatic latent image formed on the photoconductor drum 10 to form a toner image. The toner image is primarily transferred onto the intermediate transfer medium 50 by a transfer bias applied from the rollers 51. After the corona charger 52 has given charge to the toner image on the intermediate transfer medium 50, the toner image is secondarily transferred onto the recoding sheet 95. Residual toner particles remaining on the photoconductor drum 10 are removed by the cleaner 60. The photoconductor drum 10 is neutralized by the neutralization lamp 70.

Figure 2:
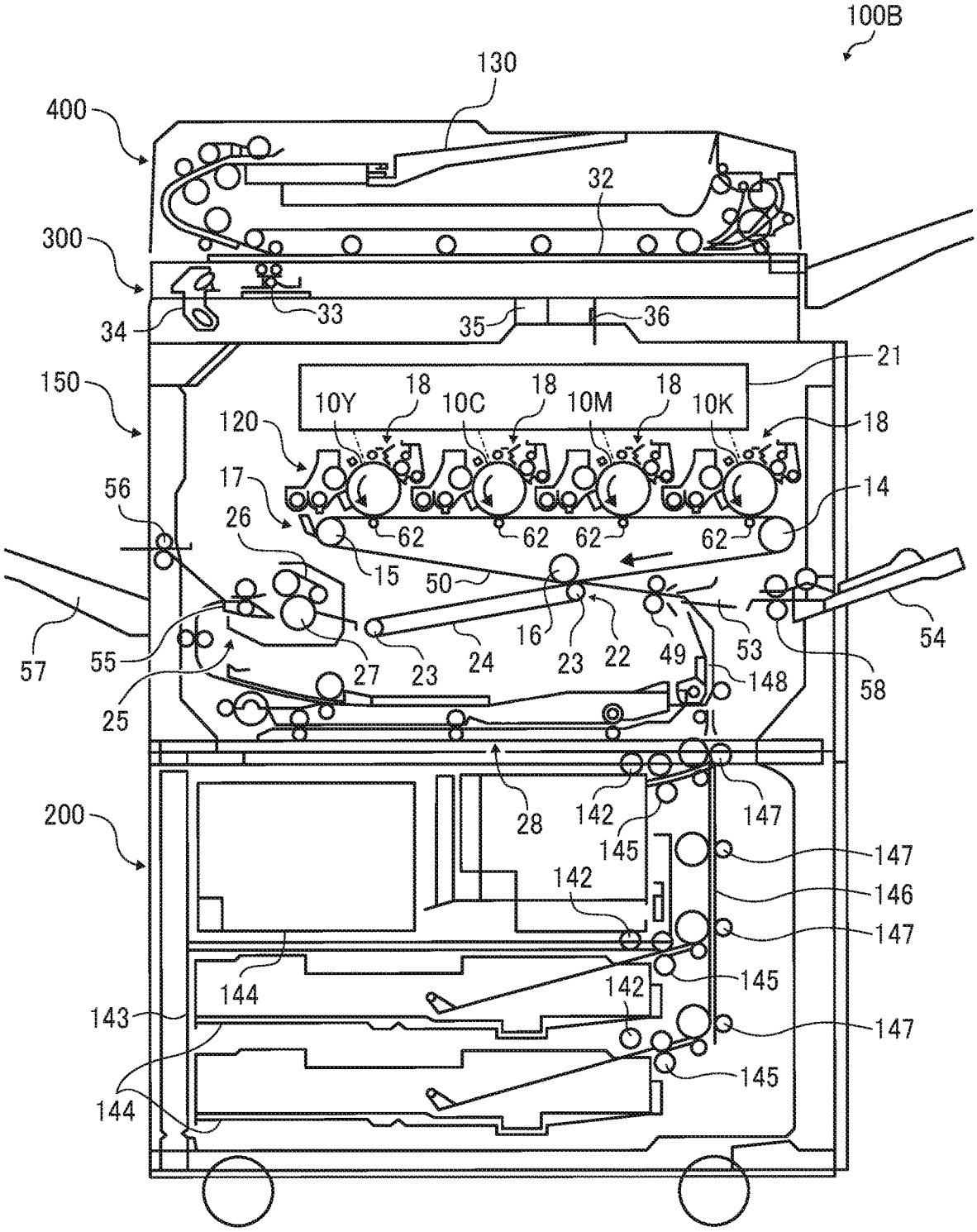
FIG. 2 is a schematic cross-sectional view of an image forming apparatus according to an embodiment of the present invention.

FIG. 2 is a schematic view of another image forming apparatus according to an embodiment of the present invention. An image forming apparatus 100B is a tandem-type full-color image forming apparatus that includes a copier main body 150, a sheet feeding table 200, a scanner 300, and an automatic document feeder (ADF) 400.

In the central part of the copier main body 150, an intermediate transfer medium 50 in the form of an endless belt is disposed.

The intermediate transfer medium 50 is stretched taut by support rollers 14, 15, and 16 and rotatable in the direction indicated by arrow in FIG. 2.

In the vicinity of the support roller 15, a cleaner 17 for removing residual toner particles remaining on the intermediate transfer medium 50 is disposed. Four image forming units 18 for respectively forming yellow, cyan, magenta, and black images are arranged in tandem facing a part of the intermediate transfer medium 50 stretched between the support rollers 14 and 15 in the direction of conveyance of the intermediate transfer medium 50, thus forming a tandem developing device 120.

Figure 3:
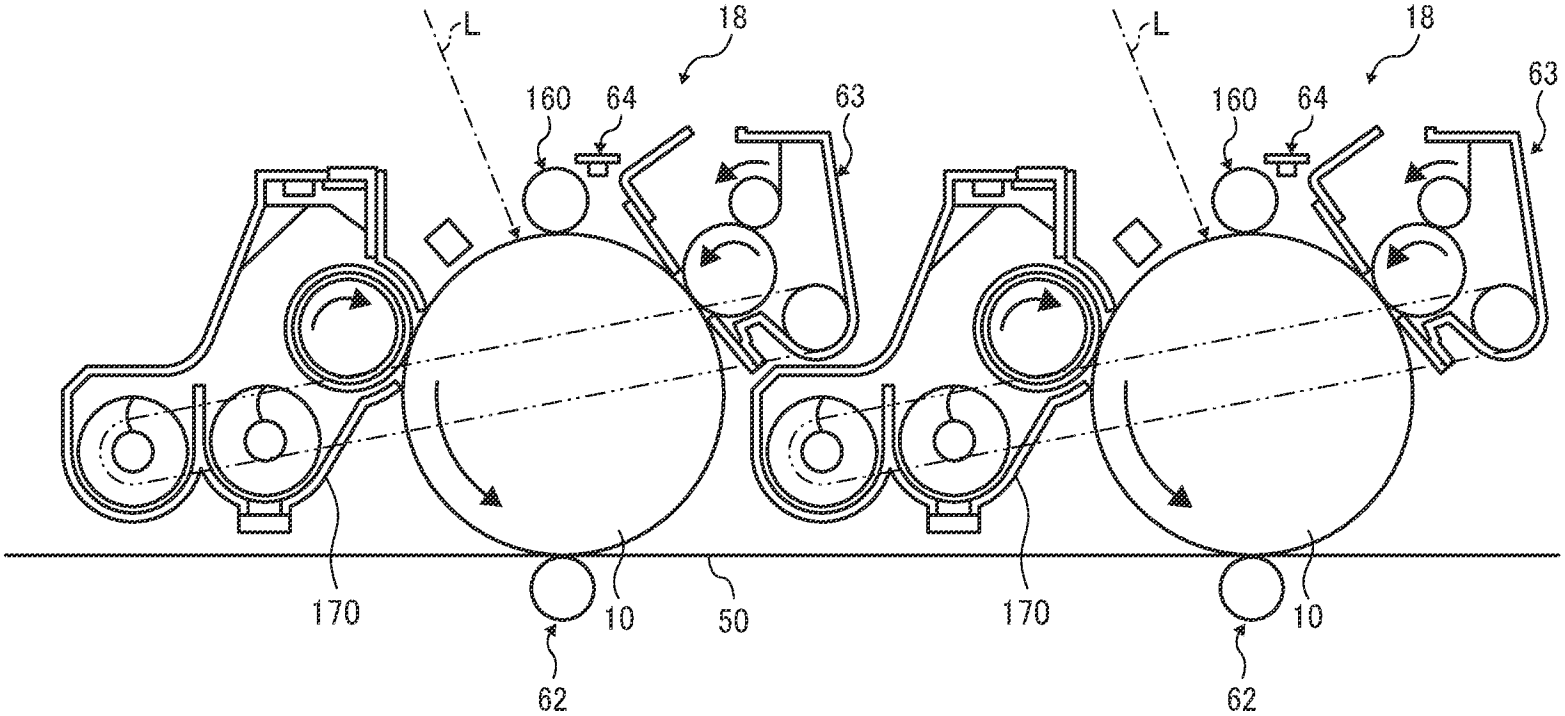
FIG. 3 is a magnified view of a major part of an image forming unit in the image forming apparatus illustrated in FIG. 2.

Referring to FIG. 3, each image forming unit 18 includes a photoconductor drum 10, a charging roller 160 to uniformly charge the photoconductor drum 10, a developing device 170 to develop an electrostatic latent image formed on the photoconductor drum 10 into a toner image with a developer of black, yellow, magenta, or cyan color, a transfer roller 62 to transfer the toner image onto the intermediate transfer medium 50, a cleaner 63, and a neutralization lamp 64.

Referring back to FIG. 2, in the vicinity of the tandem developing device 120, an irradiator 21 is disposed. The irradiator 21 emits light to the photoconductor drum 10 to form an electrostatic latent image thereon.

A secondary transfer device 22 is disposed on the opposite side of the tandem developing device 120 relative to the intermediate transfer medium 50. The secondary transfer device 22 includes a secondary transfer belt 24 in the form of an endless belt stretched taut with a pair of rollers 23. A recording sheet conveyed on the secondary transfer belt 24 and the intermediate transfer medium 50 are contactable with each other.

A fixing device 25 is disposed in the vicinity of the transfer device 22. The fixing device 25 includes a fixing belt 26 in the form of an endless belt and a pressing roller 27 pressed against the fixing belt 26.

In the vicinity of the transfer device 22 and the fixing device 25, a sheet reversing device 28 is disposed for reversing the recording sheet so that images can be formed on both surfaces of the recording sheet.

A full-color image forming (color copying) operation performed by the image forming apparatus 100B is described below. First, a document is set on a document table 130 of the automatic document feeder 400. Alternatively, a document is set on a contact glass 32 of the scanner 300 while opening the automatic document feeder 400, and the automatic document feeder 400 is then closed. As a start switch is pressed, the scanner 300 starts driving after the document is moved onto the contact glass 32 when the document is set on the automatic document feeder 400. On the other hand, the scanner 300 immediately starts driving when the document is set on the contact glass 32. After that, a first traveling body 33 and a second traveling body 34 start traveling. The first traveling body 33 emits light from a light source to the document. The second traveling body 34 reflects light reflected from the document by a mirror toward a reading sensor 36 through an imaging lens 35. Thus, the document is read and converted into image information of black, magenta, cyan, and yellow.

The irradiator 21 forms an electrostatic latent image of each color on each photoconductor drum 10Y, 10C, 10M, or 10K based on image information of each color. Each electrostatic latent image is developed into a toner image with the developer of each color supplied from each image forming unit 18 in the tandem developing device 120. The toner images are primarily transferred onto the intermediate transfer medium 50 that is rotated by the support rollers 14, 15, and 16 in a successive and overlapping manner. Thus, a composite toner image is formed on the intermediate transfer medium 50.

At the same time, in the sheet feeding table 200, one of sheet feed rollers 142 starts rotating to feed recording sheets from one of sheet feed cassettes 144 in a sheet bank 143. One of separation rollers 145 separates the recording sheets one by one and feeds them to a sheet feed path 146. Feed rollers 147 feed each sheet to a sheet feed path 148 in the copier main body 150. The sheet is stopped by striking a registration roller 49. Alternatively, recording sheets may be fed from a manual sheet feeding tray 54. In this case, a separation roller 58 separates the sheets one by one and feeds them to a manual sheet feeding path 53. The sheet is stopped by striking the registration roller 49. The registration roller 49 is generally grounded. Alternatively, the registration roller 49 may be applied with a bias for the purpose of removing paper powders from the recording sheet.

The registration roller 49 starts rotating in synchronization with an entry of the composite toner image formed on the intermediate transfer medium 50 to between the intermediate transfer medium 50 and the transfer device 22 to feed the recording sheet thereto. Thus, the composite toner image is secondarily transferred onto the recording sheet.

The recording sheet having the composite toner image thereon is fed from the transfer device 22 to the fixing device 25. In the fixing device 25, the composite toner image is heated and pressurized by the fixing belt 26 and the pressing roller 27 and thereby fixed on the recording sheet. A switch claw 55 switches sheet feed paths so that the recording sheet is ejected by an ejection roller 56 and stacked on a sheet ejection tray 57.

Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Residual toner particles remaining on the intermediate transfer medium 50 after the composite image has been transferred are removed by the cleaner 17.

Figure 4:
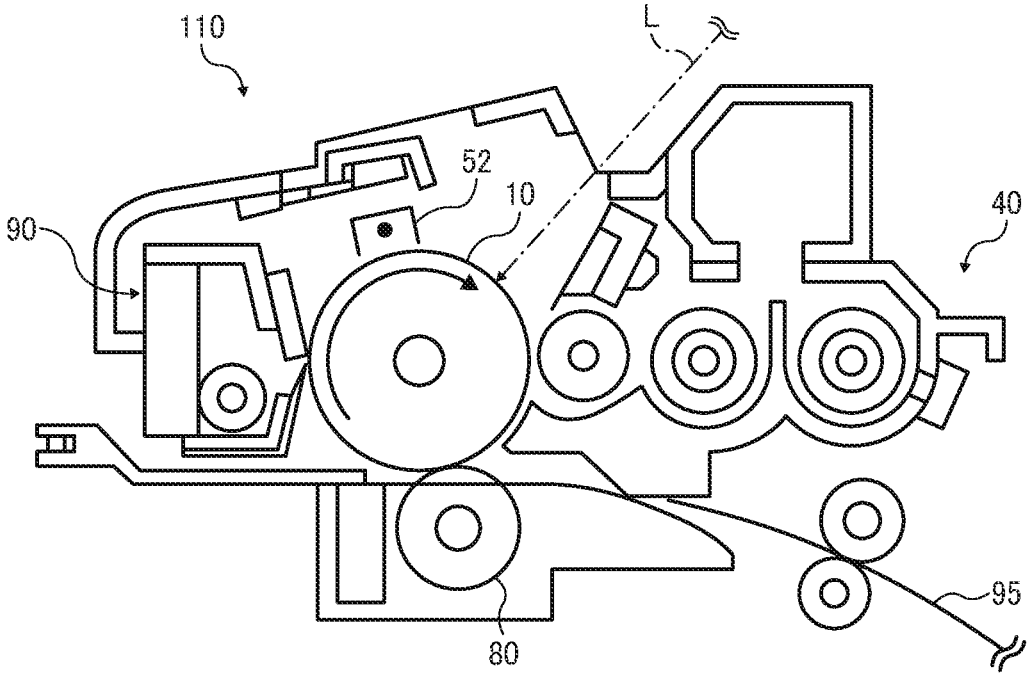
FIG. 4 is a schematic cross-sectional view of a process cartridge detachably mountable on an image forming apparatus according to an embodiment of the present invention.

FIG. 4 is a schematic view of a process cartridge according to an embodiment of the present invention.

The image forming apparatus according to an embodiment of the present invention may have a configuration in which a process cartridge is detachably mountable. A process cartridge 110 includes a photoconductor drum 10, a corona charger 52, a developing device 40, a transfer roller 80, and a cleaner 90.

EXAMPLES

Having generally described this invention, further understanding can be obtained by reference to certain specific examples which are provided herein for the purpose of illustration only and are not intended to be limiting. In the following descriptions, "parts" represent "parts by mass" unless otherwise specified.

Production of Toner

Specific examples for producing toners used for the evaluation are described below. The toner according to an embodiment of the present invention is not limited to these examples.

Synthesis of Ketimine Compound

In a reaction vessel equipped with a stirrer and a thermometer, 170 parts of isophoronediamine and 75 parts of methyl ethyl ketone were put and allowed to react at 50 degrees C. for 5 hours. Thus, a ketimine compound was prepared.

The ketimine compound had an amine value of 418.

Synthesis of Crystalline Polyester Resin A

In a reaction vessel equipped with a nitrogen introducing tube, a dewatering tube, a stirrer, and a thermocouple, 202 parts of sebacic acid and 106 parts of 1,6-hexanediol were put, and 0.2 parts of titanium tetraisopropoxide as a polycondensation catalyst were added in 10 divided portions. The vessel contents were allowed to react at 180 degrees C. for 10 hours and subsequently at 200 degrees C. for 3 hours. The vessel contents were further allowed to react under a reduced pressure of 8.3 kPa for 2 hours. Thus, a crystalline polyester resin A was prepared.

The crystalline polyester resin A had a melting point of 67 degrees C. and a weight average molecular weight of 25,000.

Synthesis of Crystalline Polyester Resin B

In a reaction vessel equipped with a nitrogen introducing tube, a dewatering tube, a stirrer, and a thermocouple, 271 parts of tetradecanedioic acid and 118 parts of 1,6-hexanediol were put, and 0.8 parts of titanium tetraisopropoxide as a polycondensation catalyst were added in 10 divided portions. The vessel contents were allowed to react at 235 degrees C. for 5 hours and subsequently at 200 degrees C. for 3 hours. The vessel contents were further allowed to react under a reduced pressure of 13.3 kPa for 1 hour. Thus, a crystalline polyester resin B was prepared.

The crystalline polyester resin B had a melting point of 64 degrees C. and a weight average molecular weight of 15,000.

Synthesis of Amorphous Polyester Resin A

In a 5-liter four-necked flask equipped with a nitrogen introducing tube, a dewatering tube, a stirrer, and a thermocouple, 229 parts of ethylene oxide 2-mol adduct of bisphenol A, 529 parts of propylene oxide 3-mol adduct of bisphenol A, 208 parts of terephthalic acid, 46 parts of adipic acid, and 2 parts of dibutyltin oxide were put, and allowed to react at 230 degrees C. under normal pressure for 7 hours and subsequently under reduced pressures of from 10 to 15 mmHg for 4 hours. Further, 44 parts of trimellitic anhydride were further put in the flask and allowed to react at 180 degrees C. under normal pressure for 2 hours. Thus, an amorphous polyester resin A was prepared.

The amorphous polyester resin A had a weight average molecular weight (Mw) of 5,800 and a glass transition temperature of 55 degrees C.

Synthesis of Amorphous Polyester Resin B

In a 5-liter four-necked flask equipped with a nitrogen introducing tube, a dewatering tube, a stirrer, and a thermocouple, 360 parts of propylene oxide 2-mol adduct of bisphenol A, 80 parts of terephthalic acid, 55 parts of fumaric acid, and 2 parts of titanium tetraisopropoxide were put, and allowed to react at 200 degrees C. under normal pressure for 10 hours and subsequently under a reduced pressure of 13.3 kPa (100 mmHg) until the softening point became 104 degrees C., then the reaction product was taken out. Thus, an amorphous polyester resin B was prepared.

Synthesis of Polyester Prepolymer A

In a reaction vessel equipped with a condenser tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide were put, and allowed to react at 230 degrees C. under normal pressure for 8 hours and subsequently under reduced pressures of from 10 to 15 mmHg for 5 hours. Thus, an intermediate polyester A was prepared.

The intermediate polyester A had a weight average molecular weight of 9,500, a glass transition temperature of 55 degrees C., an acid value of 0.5, and a hydroxyl value of 51.

Next, in a reaction vessel equipped with a condenser tube, a stirrer, and a nitrogen introducing tube, 410 parts of the intermediate polyester A, 89 parts of isophorone diisocyanate, and 500 parts of ethyl acetate were put, and allowed to react at 100 degrees C. for 5 hours. Thus, a polyester prepolymer A was prepared.

Synthesis of Polyester Prepolymer B

In a reaction vessel equipped with a condenser tube, a stirrer, and a nitrogen introducing tube, 1,430 parts of 3-methyl-1,5-pentanediol, 1,125 parts of adipic acid, 38 parts of trimellitic anhydride, and 2.6 parts of titanium tetraisopropoxide were put, heated to 200 degrees under normal pressure over a period of about 4 hours and further to 230 degrees C. over a period of 2 hours, and allowed to react until water no longer flowed out and subsequently under reduced pressures of from 10 to 15 mmHg for 5 hours. Thus, an intermediate polyester B was prepared.

Next, in a reaction vessel equipped with a condenser tube, a stirrer, and a nitrogen introducing tube, 271 parts of the intermediate polyester B, 91 parts of isophorone diisocyanate, and 362 parts of ethyl acetate were put, and allowed to react at 100 degrees C. for 5 hours. Thus, a polyester prepolymer B was prepared.

In a reaction vessel equipped with a heater, a stirrer, and a nitrogen introducing tube, the polyester prepolymer B was put and stirred, and the ketimine compound was dropped therein. At this time, the molar ratio of amino groups to isocyanate groups was 1. Next, the vessel contents were stirred at 45 degrees C. for 10 hours and thereafter dried under reduced pressures at 50 degrees C. until the remaining amount of ethyl acetate became 100 ppm or less. Thus, an amorphous polyester resin B' was prepared.

The amorphous polyester resin B' had a glass transition temperature of −55 degrees C. and a weight average molecular weight of 130,000.

The melting point, glass transition temperature, and weight average molecular weight were measured as follows.

Melting Point and Glass Transition Temperature

The melting point and glass transition temperature were measured using a differential scanning calorimeter Q-200 (available from TA Instruments) in the following manner. First, about 5.0 mg of a sample was put in an aluminum sample container. The sample container was put on a holder unit and set in an electric furnace. Next, the temperature was raised from −80 degrees C. to 150 degrees C. at a temperature rising rate of 10 degrees C./min under nitrogen gas atmosphere.

The resulted DSC curve was analyzed with an analysis program installed in the differential scanning calorimeter to determine the glass transition temperature of the sample.

The resulted DSC curve was further analyzed with an analysis program installed in the differential scanning calorimeter to determine the endothernnic peak top temperature, and this temperature was defined as the melting point.

Weight Average Molecular Weight

The weight average molecular weight was measured using a GPC (gel permeation chromatography) instrument HLC-8220GPC (available from Tosoh Corporation) equipped with triple columns TSKgel SuperHZM-H 15 cm (available from Tosoh Corporation). Specifically, the columns were stabilized in a heat chamber at 40 degrees C. Next, tetrahydrofuran (THF) was allowed to flow in the columns at a flow rate of 1 mL/min, and 50 to 200 μL of a 0.05-0.6% by mass THF solution of a sample was injected into the instrument to measure the weight average molecular weight of the sample. The weight average molecular weight of the sample was calculated from the relation between the logarithmic values and the number of counts in a calibration curve created with several types of monodisperse polystyrene standard samples.

The polystyrene standard samples were those having respective weight average molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (available from Pressure Chemical Co. or Tosoh Corporation).

As the detector, a refractive index (RI) detector was used.

Production of Particles A Composed Mainly of Strontium Titanate

Metatitanic acid obtained by a sulfuric acid method was subjected to a deironization bleaching treatment, then an aqueous solution of sodium hydroxide was added to adjust the pH to 9.0, and a desulfurization treatment was performed. After that, the pH was adjusted to 5.8 by addition of hydrochloric acid, followed by filtration washing with water. Thus, a washed cake was prepared. Water was added to the washed cake to obtain a 2 mol/L slurry of $TiO_2$, then hydrochloric acid was added thereto to adjust the pH to 1.4, followed by a peptization treatment. This metatitanic acid as $TiO_2$ in an amount of 1.50 mol was collected and put in a 3-liter reaction vessel. Next, 1.73 mol of a strontium chloride solution and 0.26 mol of a lanthanum chloride solution were added to adjust the $TiO_2$ concentration to 0.70 mol/L. After the vessel contents were heated to 90 degrees C. while stirring, 438 mL of a 10 N aqueous solution of sodium hydroxide was added thereto over a period of 2 hours, and the stirring was continued for 1 hour at 95 degrees C., thus completing the reaction.

After the reaction had been completed, the slurry was cooled to 50 degrees C., hydrochloric acid was added until the pH reached 5.0, and stirring was continued for 1 hour. After the resulted precipitate was washed by decantation, the temperature was adjusted to 50 degrees C., and the pH was adjusted to 2.5 by addition of hydrochloric acid. Next, i-butyl trimethoxysilane (surface treatment agent) in an amount of 10.0% by weight based on solid contents was added, and stirring was continued for 6 hours. After that, trifluoropropyl trimethoxysilane (surface treatment agent) in an amount of 3.0% by weight was added, and stirring was continued for 14 hours. Next, a sodium hydroxide solution was added to adjust the pH to 6.5, and stirring was continued for 1 hour, followed by filtration washing. The resulted cake was dried in the air at 120 degrees C. for 10 hours, thus obtaining particles A composed mainly of strontium titanate. The molar ratio (Sr+La)/Ti in the particles A composed mainly of strontium titanate was 0.88, and the number average primary particle diameter was 40 nm.

Production of Particles B to G Composed Mainly of Strontium Titanate

Particles B to G composed mainly of strontium titanate were produced in the same manner as the particles A composed mainly of strontium titanate except for changing the reaction conditions as described in Table 1.

TABLE 1

| | | | | A | B | C | D | E | F | G |
|---|---|---|---|---|---|---|---|---|---|---|
| Particles Composed Mainly of Strontium Titanate | Reaction Conditions | $TiO_2$ | mol | 1.50 | 1.50 | 1.50 | 1.50 | 1.50 | 1.50 | 1.50 |
| | | $SrCl_2$ | mol | 1.73 | 1.73 | 1.73 | 1.73 | 1.73 | 1.73 | 1.73 |
| | | $LaCl_3$ | mol | 0.26 | 0.17 | | | | | 0.00 |
| | | $MgCl_2$ | mol | | | 0.17 | | | | |
| | | $CaCl_2$ | mol | | | | 0.09 | | | |
| | | $SnCl_2$ | mol | | | | | 0.17 | | |
| | | $Na_2SiO_3$ | mol | | | | | | 0.09 | |
| | | M/Sr | — | 15 | 10 | 10 | 5 | 10 | 5 | 0 |
| | | Initial Ti Concentration | mol/L | 0.70 | 0.70 | 0.70 | 0.70 | 0.70 | 0.70 | 0.70 |
| | | Reaction Temperature | (° C.) | 90 | 90 | 90 | 90 | 80 | 90 | 90 |
| | Physical Properties | (Sr + M)/Ti | — | 0.88 | 0.86 | 0.73 | 0.71 | 0.79 | 0.83 | 0.89 |
| | | Average Primary Particle Diameter | nm | 40 | 40 | 50 | 50 | 50 | 50 | 40 |

The molar ratio (Sr+La)/Ti and the number average primary particle diameter were determined as follows.

Molar Ratio (Sr+La)/Ti

Using an X-ray fluorescence analyzer XRF-1700 available from Shimadzu Corporation, the count value of each element was measured, and the molar ratio was calculated based on the Fundamental Parameter method (JIS K 0119: 2008).

Number Average Primary Particle Diameter

A scanning electron microscope (SEM) image of the particles composed mainly of strontium titanate was obtained using a field emission scanning electron microscope SU8230 (available from Hitachi High-Tech Corporation), and the number average particle diameter was measured by image analysis. First, the particles composed mainly of strontium titanate were dispersed in tetrahydrofuran as a solvent, then dried on a substrate by removing the solvent. The resulted sample was observed with the SEM to obtain an image, and the longest length of each primary particle was measured. The average value of the measured values for 50 particles was calculated as the number average particle diameter. The measurement conditions of the SEM were as follows.

Measurement Conditions of SEM

Acceleration Voltage: 2.0 kV

WD (Working Distance): 5.0 mm

Observation Magnification: 100,000 times

Preparation of Master Batch (MB)

First, 1,200 parts of water, 540 parts of a carbon black (PRINTEX 35 manufactured by Degussa (now available from Orion Engineered Carbons), having a DBP oil absorption of 42 mL/100 mg and a pH of 9.5), and 1,200 parts of the amorphous polyester resin A were mixed by a HENSCHEL MIXER (manufactured by Mitsui Mining and Smelting Co., Ltd.). The mixture was kneaded by a double roll at 150 degrees C. for 30 minutes, then rolled to cool, and pulverized by a pulverizer. Thus, a master batch was prepared.

Preparation of Amorphous Polyester Resin-Pigment-Wax Dispersion Liquid A1

In a reaction vessel equipped with a stirrer and a thermometer, 378 parts of the amorphous polyester resin A, 110 parts of a carnauba wax, 22 parts of a charge controlling agent (salicylic acid metal complex E-84 manufactured by Orient Chemical Industries Co., Ltd.), and 947 parts of ethyl acetate were put, heated to 80 degrees C. while being stirred, kept at 80 degrees C. for 5 hours, and cooled to 30 degrees C. over a period of 1 hour. Next, 500 parts of the master batch and 500 parts of ethyl acetate were put in the vessel and mixed for 1 hour. Thus, a raw material liquid was prepared.

The raw material liquid in an amount of 1,324 parts was transferred in another vessel and subjected to a dispersion treatment for the carbon black and the wax 3 times (3 passes) using a bead mill (ULTRAVISCOMILL available from AIMEX CO., Ltd.) filled with 80% by volume of zirconia beads having a diameter of 0.5 mm at a liquid feeding speed of 1 kg/hour and a disc peripheral speed of 6 m/sec. Next, 900 parts of a 65% ethyl acetate solution of the amorphous polyester resin A were added, and the raw material liquid was subjected to the dispersion treatment using the bead mill under the above-described conditions once (1 pass). Thus, a pigment-wax dispersion liquid A1 was prepared.

The solid content concentration (130 degrees C., 30 minutes) of the pigment-wax dispersion liquid A1 was 55%.

Preparation of Amorphous Polyester Resin-Pigment-Wax Dispersion Liquid A2

In a reaction vessel equipped with a stirrer and a thermometer, 378 parts of the amorphous polyester resin A, 110 parts of a carnauba wax, 22 parts of a charge controlling agent (salicylic acid metal complex E-84 manufactured by Orient Chemical Industries Co., Ltd.), and 947 parts of ethyl acetate were put, heated to 80 degrees C. while being stirred, kept at 80 degrees C. for 5 hours, and cooled to 30 degrees C. over a period of 1 hour. Next, 500 parts of the master batch and 500 parts of ethyl acetate were put in the vessel and mixed for 1 hour. Thus, a raw material liquid was prepared.

The raw material liquid in an amount of 1,324 parts was transferred in another vessel and subjected to a dispersion treatment for the carbon black and the wax 3 times (3 passes) using a bead mill (ULTRAVISCOMILL available from AIMEX CO., Ltd.) filled with 80% by volume of zirconia beads having a diameter of 0.5 mm at a liquid feeding speed of 1 kg/hour and a disc peripheral speed of 6 m/sec. Next, 1,042.3 parts of a 65% ethyl acetate solution of the amorphous polyester resin A were added, and the raw material liquid was subjected to the dispersion treatment using the bead mill under the above-described conditions once (1 pass). Thus, a pigment-wax dispersion liquid A2 was prepared.

The solid content concentration (130 degrees C., 30 minutes) of the pigment-wax dispersion liquid A2 was 50%.

Preparation of Crystalline Polyester Dispersion Liquid A

In a 2-liter metallic vessel, 100 g of a crystalline polyester resin A and 400 g of ethyl acetate were put, then heat-melted at 75 degrees C., and rapidly cooled at a rate of 27 degrees C./min in an ice water bath. After adding 500 ml of glass beads (having a diameter of 3 mm) to the vessel, the vessel contents were subjected to a pulverization treatment by a batch-type sand mill (manufactured by Kanpe Hapio Co., Ltd.) for 10 hours. Thus, a crystalline polyester dispersion liquid A was prepared.

Preparation of Crystalline Polyester Dispersion Liquid B

A crystalline polyester resin B in an amount of 100 parts by mass was pulverized by a grinding machine ROUNDEL MILL RM (available from TOKUJU CORPORATION) and mixed with 638 parts by mass of a 0.26% by mass sodium lauryl sulfate solution prepared in advance. This mixture was subjected to an ultrasonic dispersion using an ultrasonic homogenizer US-150T (available from NIHONSEIKI KAISHA LTD.) at V-LEVEL and 300 ρA for 30 minutes while being stirred. Thus, a crystalline polyester dispersion liquid B having a volume-based median diameter of 200 nm was prepared.

Preparation of Organic Particle Dispersion Liquid

In a reaction vessel equipped with a stirrer and a thermometer, 683 parts of water, 11 parts of a sodium salt of a sulfate of ethylene oxide adduct of methacrylic acid (ELEMINOL RS-30 manufactured by Sanyo Chemical Industries, Ltd.), 138 parts of styrene, 138 parts of methacrylic acid, and 1 part of ammonium persulfate were put and stirred at a revolution of 400 rpm for 15 minutes. Thus, a white emulsion was prepared. The emulsion was heated to raise the reaction system temperature to 75 degrees C. and subjected to a reaction for 5 hours. A 1% aqueous solution of ammonium persulfate in an amount of 30 parts was further added to the emulsion, and the emulsion was aged at 75 degrees C. for 5 hours. Thus, a particle dispersion liquid was prepared, which was an aqueous dispersion liquid of a vinyl resin (i.e., a copolymer of styrene, methacrylic acid, and a sodium salt of a sulfate of ethylene oxide adduct of methacrylic acid).

The volume average particle diameter of the particle dispersion liquid measured by an instrument LA-920 was 0.14 μm.

A part of the particle dispersion liquid was dried to isolate the resin component.

Preparation of Styrene Acrylic Resin-Wax Dispersion Liquid a (1) First Stage Polymerization In a reaction vessel equipped with a stirrer, a temperature sensor, a condenser tube, and a nitrogen introducing device, 8 parts by mass of sodium dodecyl sulfate were dissolved in 3,000 parts by mass of ion-exchange water to prepare a surfactant solution, and the inner temperature was raised to 80 degrees C. while stirring the surfactant solution at a stirring rate of 230 rpm under a nitrogen gas stream. After the temperature had been raised, a solution prepared by dissolving 10 parts by mass of potassium persulfate (KPS) in 200 parts by mass of ion-exchange water was added to the above-prepared surfactant solution, then the temperature of the liquid was adjusted to 80 degrees C. again, and a polymerizable monomer mixture liquid containing the following compounds was added dropwise over a period of 1 hour.

Styrene: 480 parts by mass
n-Butyl acrylate: 250 parts by mass
Methacrylic acid: 68 parts by mass
n-Octyl-3-mercaptopropionate: 16 parts by mass After the dropwise addition of the polymerizable monomer mixture liquid, the system was heated and stirred at 80 degrees C. for 2 hours to carry out a polymerization (first stage polymerization). Thus, a resin particle dispersion liquid [1H] containing resin particles [1h] was prepared.

(2) Second Stage Polymerization

In a flask equipped with a stirrer, the following compounds were put and heated to 90 degrees C. to be melted. Thus, a mixture liquid containing polymerizable monomers and release agent was prepared.

Styrene: 245 parts by mass n-Butyl acrylate: 120 parts by mass n-Octyl-3-mercaptopropionate: 1.5 parts by mass Carnauba wax: 110 parts by mass On the other hand, a surfactant solution prepared by dissolving 7 parts by mass of sodium polyoxyethylene-2-dodecyl ether sulfate in 800 parts by mass of ion-exchange water was heated to 98 degrees C. To this surfactant solution, the resin particle dispersion liquid [1H] containing the resin particles [1h] in an amount of 260 parts by mass in terms of solid content and the mixture liquid containing polymerizable monomers and release agent were added. After the addition, a mixing and dispersing treatment was performed for 1 hour using a mechanical disperser CLEARMIX (available from M Technique Co., Ltd.) having a circulation path. Thus, a dispersion liquid containing emulsified particles was prepared.

Next, a solution prepared by dissolving 6 parts by mass of potassium persulfate in 200 parts by mass of ion-exchange water was added to the above-prepared dispersion liquid, and the system was heated and stirred at 82 degrees C. for 1 hour to carry out a polymerization (second stage polymerization). Thus, a resin particle dispersion liquid [1HM] containing resin particles [1hm] was prepared.

(3) Third Stage Polymerization

An initiator solution prepared by dissolving 11 parts by mass of potassium persulfate in 400 parts by mass of ion-exchange water was added to the above-prepared resin particle dispersion liquid [1HM], then the temperature of the liquid was adjusted to 80 degrees C., and a polymerizable monomer mixture liquid containing the following compounds was added dropwise over a period of 1 hour.

Styrene: 435 parts by mass n-Butyl acrylate: 130 parts by mass

Methacrylic acid: 33 parts by mass n-Octyl-3-mercaptopropionate: 8 parts by mass After completion of the dropwise addition of the polymerizable monomer mixture liquid, the system was heated and stirred for 2 hours to carry out a polymerization (third stage polymerization), then cooled to 28 degrees C. Thus, a styrene acrylic resin-wax dispersion liquid A containing resin particles [a] was prepared. The particle size of the resin particles [a] contained in the styrene acrylic resin-wax dispersion liquid A was measured using an electrophoretic light scattering photometer ELS-800 (available from Otsuka Electronics Co., Ltd.). As a result, the volume-based median diameter was 150 nm. The glass transition temperature measured by a known method was 45 degrees C. The weight average molecular weight of the resin constituting the resin particles [a] was 32,000.

Preparation of Amorphous Polyester Resin Dispersion Liquid B

An amorphous polyester resin B in an amount of 100 parts by mass was pulverized by a grinding machine ROUNDEL MILL RM (available from TOKUJU CORPORATION) and mixed with 638 parts by mass of a 0.26% by mass sodium lauryl sulfate solution prepared in advance. This mixture was subjected to an ultrasonic dispersion using an ultrasonic homogenizer US-150T (manufactured by NIHONSEIKI KAISHA LTD.) at V-LEVEL and 300 μA for 30 minutes while being stirred. Thus, an amorphous polyester resin dispersion liquid B having a volume-based median diameter of 250 nm was prepared.

Preparation of Pigment Dispersion Liquid

While stirring a solution prepared by dissolving 90 parts by mass of sodium dodecyl sulfate in 1,600 parts by mass of ion-exchange water, 420 parts by mass of C.I. Pigment Blue 15:3 (manufactured by Toyo Ink Co., Ltd.) were gradually added thereto. Next, a dispersing treatment was performed using a stirrer CLEARMIX (available from M Technique Co., Ltd.). Thus, a pigment dispersion liquid was prepared.

Preparation of Wax Dispersion Liquid

First, 50 parts by mass of a paraffin wax (melting point: 73 degrees C.), 2 parts by mass of sodium n-dodecyl sulfate, and 200 parts by mass of ion-exchange water were heated to 120 degrees C., then mixed and dispersed using an ULTRA-TURRAX T50 available from IKA Japan K.K., and subjected to a dispersion treatment using a pressure discharge homogenizer. Thus, a wax dispersion liquid having a volume average particle diameter of 200 nm and a solid content concentration of 20% was prepared.

Production of Toner 1

Preparation of Aqueous Phase

An aqueous phase was prepared by stir-mixing 990 parts of water, 83 parts of the particle dispersion liquid, 37 parts of a 48.5% aqueous solution of sodium dodecyl diphenyl ether disulfonate (ELEMINOL MON-7 manufactured by Sanyo Chemical Industries, Ltd.), and 90 parts of ethyl acetate. The aqueous phase was a milky white liquid.

Emulsification and Solvent Removal

In a vessel, 500 parts of the amorphous polyester resin-pigment-wax dispersion liquid A1, 96 parts of the prepolymer A, 150 parts of the crystalline polyester dispersion liquid A, and 4.0 parts of the ketimine compound were put and stirred using a TK HOMOMIXER (available from PRIMIX Corporation) at a revolution of 5,000 rpm for 1 minute. Further, 1,200 parts of the aqueous phase were added to the vessel, and the vessel contents were mixed using a TK HOMOMIXER at a revolution of 8,000 rpm for 60 seconds. Thus, an emulsion slurry was prepared.

The emulsion slurry was put in a vessel equipped with a stirrer and a thermometer and subjected to solvent removal at 30 degrees C. for 8 hours and subsequently to aging at 45 degrees C. for 4 hours. Thus, a dispersion slurry was prepared.

Washing and Drying

After 100 parts of the dispersion slurry was filtered under reduced pressures:

(1) 100 parts of ion-exchange water were added to the resulted filter cake and mixed using a TK HOMOMIXER (at a revolution of 12,000 rpm for 10 minutes), followed by filtration;

(2) 100 parts of a 10% aqueous solution of sodium hydroxide were added to the filter cake of (1) and mixed using a TK HOMOMIXER (at a revolution of 12,000 rpm for 30 minutes), followed by filtration under reduced pressures;

(3) 100 parts of a 10% aqueous solution of hydrochloric acid were added to the filter cake of (2) and mixed using a TK HOMOMIXER (at a revolution of 12,000 rpm for 10 minutes, followed by filtration; and (4) 300 parts of ion-exchange water were added to the filter cake of (3) and mixed using a TK HOMOMIXER (at a revolution of 12,000 rpm for 10 minutes), followed by filtration. These operations were repeated twice, thus obtaining a final filter cake.

The final filter cake was dried by a circulating air dryer at 45 degrees C. for 48 hours and then filtered with a mesh having an opening of 75 μm. Thus, toner base particles 1 were prepared.

External Addition Treatment

The toner base particles 1 in an amount of 100 parts was mixed with 2.0 parts of a large particle size hydrophobic silica UFP-35 (having an average primary particle diameter of 78 nm, manufactured by Denka Company Limited, hereinafter "silica A"), 1.6 parts of a small particle size hydrophobic silica RX-50 (having an average primary particle diameter of 40 nm, manufactured by Nippon Aerosil Co., Ltd., hereinafter "silica B"), and 0.6 parts of the particles A composed mainly of strontium titanate using a HENSCHEL MIXER (manufactured by Mitsui Mining Co., Ltd.), and then passed through a 500-mesh sieve. Thus, a toner 1 was prepared.

Production of Toners 2 to 18

Toners 2 to 18 were prepared in the same manner as Toner 1 except that the number of parts of the oil phase prepared and the number of parts of the external additive in the process of emulsification and solvent removal in preparing Toner 1 were changed as described in Tables 2-1, 2-2, and 3. In the Tables, "Titanium oxide ST-550" represents a hydrophobic titanium oxide ST-550 (having an average primary particle diameter of 40 nm, manufactured by Titan Kogyo, Ltd.), and "Alumina" represents AEROXIDE Alu C 805 (having an average primary particle diameter of 13 nm, manufactured by Nippon Aerosil Co., Ltd.).

Production of Toner 19

The following materials were put in a reaction vessel equipped with a stirrer, a temperature sensor, a condenser tube, and a nitrogen introducing device.

Styrene acrylic resin-wax dispersion liquid A: 300 parts by mass (in terms of solid content)

Ion-exchange water: 1,400 parts by mass

Pigment dispersion liquid: 24.5 parts by mass (in terms of solid content) Next, a solution prepared by dissolving 3 parts by mass of sodium polyoxyethylene-2-dodecyl sulfate in 120 parts by mass of ion-exchange water was further added to the reaction vessel, then the temperature of the liquid was adjusted to 30 degrees C., and a 5 mol/liter aqueous solution of sodium hydroxide was added to adjust the pH to 10.

Next, an aqueous solution prepared by dissolving 35 parts by mass of magnesium chloride hexahydrate in 35 parts by mass of ion-exchange water was added over a period of 10 minutes at 30 degrees C. under stirring, held for 3 minutes, then temperature rising was started. The temperature was raised to 90 degrees C. over a period of 60 minutes, and the particles were allowed to agglomerate and fuse while the temperature was maintained at 90 degrees C. The particle size of the particles growing in the reaction vessel was monitored using MULTISIZER 3 (available from Beckman Coulter, Inc.). At the time when the volume-based median diameter became 6.5 μm, an aqueous solution prepared by dissolving 150 parts by mass of sodium chloride in 600 parts by mass of ion-exchange water was added to terminate the growth of the particles. Further, as an aging treatment, the temperature of the liquid was adjusted to 98 degrees C. and the vessel contents were stirred under heat to advance fusion of the particles until the average circularity measured by an instrument FPTA-2100 (manufactured by Sysmex Corporation) became 0.965.

The temperature of the liquid was cooled to 30 degrees C., the pH of the liquid was adjusted to 2 using hydrochloric acid, and stirring was stopped. Thus, a toner base particle dispersion liquid [B1] was prepared.

The above-prepared toner base particle dispersion liquid [B1] was subjected to solid-liquid separation using a basket-type centrifuge MARK III Model No. 60×40 (available from Matsumoto Machine Manufacturing Co., Ltd.). Thus, a wet cake of toner base particles [b1] was prepared.

The wet cake was washed with ion-exchange water at 45 degrees C. in the basket-type centrifuge until the electrical conductivity of the filtrate became 5 μS/cm, then transferred to a flash jet dryer (available from Seishin Enterprise Co., Ltd.) and subjected to a drying treatment until the amount of water became 0.5% by mass. Thus, toner base particles [b1] in cyan color were prepared.

The number of parts of the external additive with respect to the toner base particles [b1] was changed as described in Table 3. Thus, a toner 19 was prepared.

Production of Toner 20

In a reaction vessel equipped with a stirrer, a temperature sensor, and a condenser tube, 250 parts by mass (in terms of solid content) of the amorphous polyester resin dispersion liquid B, 47 parts by mass (in terms of solid content) of the crystalline polyester resin dispersion liquid B, 18 parts by mass (in terms of solid content) of the wax dispersion liquid, and 2,000 parts by mass of ion-exchange water were put, and a 5 mol/liter aqueous solution of sodium hydroxide was added thereto to adjust the pH to 10 at 30 degrees C. After that, 26 parts by mass (in terms of solid content) of the pigment dispersion liquid were put therein. Next, an aqueous solution prepared by dissolving 60 parts by mass of magnesium chloride in 60 parts by mass of ion-exchange water was added over a period of 10 minutes at 30 degrees C. under stirring. After the system was left to stand for 3 minutes, the temperature of the system was raised to 80 degrees C. over a period of 60 minutes, and the particle growth reaction was continued while maintaining the temperature at 80 degrees C. The particle size of associated particles was monitored using MULTISIZER 3 (manufactured by Beckman Coulter, Inc.). At the time when the volume-based median diameter became 6.5 μm, an aqueous solution prepared by dissolving 190 parts by mass of sodium chloride in 760 parts by mass of ion-exchange water was added to terminate the growth of the particles. The temperature was further raised to 90 degrees C., and the vessel contents were stirred under heat to advance fusion of the particles. At the time when the average circularity became 0.955, measured by a measuring instrument FPIA-2100 (available from Sysmex Corporation) used for measuring the average circularity of toner (at HPF detection number of 4,000), the system was cooled to 30 degrees C. Thus, a toner base particle dispersion liquid [B2] was prepared.

The toner base particle dispersion liquid [B2] was subjected to solid-liquid separation by a centrifuge to prepare a wet cake of the toner base particles [b2]. The wet cake was washed with ion-exchange water at 35 degrees C. in the centrifuge until the electrical conductivity of the filtrate became 5 μS/cm, then transferred to a flash jet dryer (available from Seishin Enterprise Co., Ltd.) and subjected to a drying treatment until the amount of water became 0.5% by mass. Thus, toner base particles [b2] were prepared.

The number of parts of the external additive with respect to the toner base particles [b2] was changed as described in Table 3. Thus, a toner 20 was prepared.

The number average particle diameter Dn of toner, the average value X of the amount of deformation of toner by micro-indentation, the covering ratio of toner with external additives, and the radius R were measured as follows.

Measurement of Dn

Dn of the toner was measured using a COULTER MULTISIZER II (available from Beckman Coulter, Inc.). First, 0.1 to 5 mL of a polyoxyethylene alkyl ether as a dispersant was added to 100 to 150 mL of an electrolyte aqueous solution. Here, the electrolyte aqueous solution is a 1% NaCl aqueous solution prepared with the first grade sodium chloride, such as ISOTON-II (available from Beckman Coulter, Inc.). Further, 2 to 20 mg of the toner was added thereto. The electrolyte aqueous solution in which the toner was suspended was dispersed for about 1 to 3 minutes using an ultrasonic disperser, and then the particle size and number of the toner particles were measured using a 100-1 μm aperture to determine Dn.

Thirteen channels with the following ranges were used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm were measured.

Measurement of X

The amount of deformation of toner by micro-indentation was measured using a nanoindentation hardness tester ENT-2100 (available from ELIONIX INC.).

The measurement procedure was as follows.

This apparatus creates a load-displacement curve by measuring the load on and displacement of the indenter when the indenter is pushed into a sample. The amount of deformation of toner can be measured from this curve. The procedure of an indentation test was as follows. As a measurement was started, the indenter was pushed at a constant loading rate, and the load reached the maximum. A micro-indentation test was performed under the following measurement conditions.

Indenter: 20 μm×20 μm plane indenter

Measurement environment: 32 degrees C., 40% RH

Loading Rate: $3.0\times10^{-5}$ N/sec

Maximum load: $3.0\times10^{-4}$ N

Number of toner particles to be measured: 30

Specifically, toner particles were placed on a glass substrate and blown with the air, thus made present one by one without agglomerating. Using a microscope attached to the apparatus, whether the toner particles were being present one by one is confirmed, and toner particles to be measured were selected. At that time, the major axis and the minor axis of each toner particle were measured using a software program attached to the apparatus, and only toner particles having a major axis of Dn±0.3 μm were selected to avoid the particle diameter of toner particles to be measured from biasing. In a case in which toner particles got adhered to the indenter through the micro-indentation test, the adhered toner particles were wiped off with a piece of soft cloth. After that, a load-displacement curve was created by pressing the indenter against the substrate to confirm that no toner particle was remaining on the indenter before the next measurement.

Here, the average value of the amount of deformation of toner when the load reached the maximum was defined as X.

Covering Ratio of Toner with External Additives

The covering ratio of toner with external additives was measured by observing toner with a field emission scanning electron microscope ("SEM") SU8230 (available from Hitachi High-Tech Corporation) and analyzing an image of the toner. Specific procedures were as follows. A piece of carbon tape was stuck on a sample table for SEM, and toner particles were placed thereon. The toner particles were blown by the air to be dispersed on the piece of carbon tape and introduced into the SEM. First, at a low magnification, a field of view where 40 or more toner particles without being overlapped with each other were observed was photographed. Next, at a high magnification, a secondary electron image of each toner particle in this field of view was acquired. At this time, care was taken to increase the depth of focus, focus on the front of the toner, and add contrast to the extent that no overexposure or underexposure occurred. As a result, the external additives were photographed brighter than the surface of the toner base. The image was read by an image processing software program ImageJ and trimmed so that the front of the toner was in focus and the toner appeared on the entire image. At this time, the area of trimming was 1-μm square or larger. In a case in which this requirement was not satisfied, the image was excluded from the measurement without performing the subsequent procedures. The trimmed image was binarized by a discriminant analysis method (Otsu's binarization method) in a binarization process of image adjustment, thus identifying toner base particles and external additives. The number of pixels for the external additives among all the pixels was counted to calculate the covering ratio of one toner particle with the external additives. This procedure was performed on all toner particles observed at the low magnification, and the average value was defined as the covering ratio of the toner with the external additives.

The measurement conditions of the SEM were as follows.

Measurement Conditions of SEM

Low Magnification

Acceleration Voltage: 2.0 kV

WD (Working Distance): 15.0 mm

Observation Magnification: 1,000 times

High Magnification

Acceleration Voltage: 2.0 kV

WD (Working Distance): 15.0 mm

Observation Magnification: 15,000 times

Confirmation of Presence of Particles Composed Mainly of Strontium Titanate and Calculation of Radius R The presence of the particles composed mainly of strontium titanate was confirmed by identifying elements with a combination of SEM and an energy dispersive X-ray analysis (EDX) image. The radius R was calculated by mapping an electronic image of toner particle on a spreadsheet and determining coordinates of three points on the contour of the toner particle by treating the cells constituting the contour of the toner particles as coordinates.

First, a secondary electron image of toner was obtained with a field emission scanning electron microscope ("SEM") SU8230 (available from Hitachi High-Tech Corporation). A piece of carbon tape was stuck on a sample table for SEM, and toner particles were placed thereon. The toner particles were blown by the air to be dispersed on the piece of carbon tape and introduced into the SEM. First, at a low magnification, a field of view where 40 or more toner particles without being overlapped with each other were observed was photographed. Next, at a high magnification, the front of each toner particle in this field of view was magnified and photographed. At this time, the magnification was 500,000 times or more, and the number of pixels was 1280*960 pixels or more. Further, the image was subjected to energy dispersive X-ray analysis (EDX) to identify titanium element, strontium element, and the third element M, and 80% or more of the entire projected image of the particle containing these elements was subjected to quantitative analysis. As a result of the quantitative analysis, when titanium, strontium, and the third element M were contained and the total ratio of the two elements, i.e., titanium and strontium, was 50% or more of the total detected metal elements, the particles were determined to be particles composed mainly of strontium titanate.

The measurement conditions of the SEM were as follows.

Measurement Conditions of SEM

Low Magnification

Acceleration Voltage: 2.0 kV

WD (Working Distance): 15.0 mm

Observation Magnification: 1,000 times

High Magnification

Acceleration Voltage: 12.0 kV

WD (Working Distance): 12.0 mm

Observation Magnification: 500,000 times

Next, one particle of the external additive in the SEM image was read by an image processing software program ImageJ, and the image was trimmed so that only one of the particles composed mainly of strontium titanate was captured. The image was binarized by a discriminant analysis method (Otsu's binarization method) to make the background white and the particles black, and a process of filling voids in the particles was performed based on particle analysis.

This binarized image was output as text data and mapped on a spreadsheet of EXCEL, and cells having a numeric value of 255 were painted in black (RGB (0,0,0)). At this time, a case where the particles and the background were not separated was excluded from the measurement.

The distance per pixel was determined from the scale of the SEM image, and whether the longest length of the particle was 30 nm or more was determined.

A cell whose peripheral cells were not all black was taken as a contour portion of the particle. An arbitrary point on the contour of the particle was defined as a reference point A, another point on the contour of the particle linearly distant from the reference point A for 15 nm in one direction was defined as a point B, another point on the contour of the particle linearly distant from the reference point A for 15 nm in another direction was defined as a point C, and the radius of the circumscribed circle of the triangle formed by the points A, B and C was calculated. This operation was performed at all points on the contour, and the smallest radius R was determined.

These series of operations were performed using appropriate programming.

This operation was performed for all the particles composed mainly of strontium titanate which were observed at the high magnification, and further for all the toner particles which were observed at the low magnification. Among the calculated values of R, 20% from the bottom and 20% from the top were excluded and the remaining data was used to determine the average value.

Frequency of Particles Satisfying 11 nm≤R≤13 nm Among the particles the smallest radius R of which had been measured as above, particles satisfying 11 nm≤R≤13 nm were counted and the frequency was calculated.

Preparation of Carrier

As a core material, manganese (Mn) ferrite particles (having a weight average particle diameter of 35 μm) in an amount of 5,000 parts were used.

A coating liquid was prepared by dispersing the following materials using a stirrer for 10 minutes: 300 parts of toluene, 300 parts of butyl cellosolve, 60 parts of an acrylic resin solution (molar compositional ratio=methacrylic acid:methyl methacrylate:2-hydroxyethyl acrylate=5:9:3, a toluene solution having a solid content concentration of 50%, Tg=38 degrees C.), 15 parts of an N-tetramethoxymethyl benzoguanamine resin solution (degree of polymerization=1.5, a toluene solution having a solid content concentration of 77%), and 15 parts of alumina particles (average primary particle diameter=0.30 m).

The core material and the coating liquid were put into a coating device equipped with a fluidized bed having a rotary bottom disc and stirring blades, configured to generate a swirl flow, so that the coating liquid was applied to the core material. The coated core material was calcined in an electric furnace at 220 degrees C. for 2 hours. Thus, a carrier was prepared.

Production of Developer

The carrier in an amount of 100 parts and the toner 1 in an amount of 7 parts were uniformly mixed by a TURBLA mixer (available from Willy A. Bachofen AG), configured to perform stirring by rolling of a container, at a revolution of 48 rpm for 5 minutes. Thus, a developer 1, which was a two-component developer, was prepared.

Developers 2 to 20 were prepared in the same manner as the developer 1 except that the toner 1 was replaced with the toners 2 to 20, respectively.

Production of Electrophotographic Photoconductor 1

An undercoat layer coating liquid, a charge generation layer coating liquid, and a charge transport layer coating liquid, each having the following compositions, were successively applied onto an aluminum cylinder having a diameter of 30 mm and dried. Thus, an undercoat layer, a charge generation layer, and a charge transport layer, respectively having thicknesses of 3.5 μm, 0.2 μm, and 20 μm, were formed.

Composition of Undercoat Layer Coating Liquid

Alkyd resin (BECKOSOL 1307-60-EL available from DIC Corporation): 12 parts by weight Melamine resin (SUPER BECKAMINE G-821-60 available from DIC Corporation): 8 parts by weight Titanium oxide (CR-EL available from Ishihara Sangyo Kaisha, Ltd.): 80 parts by weight Methyl ethyl ketone: 250 parts by weight Composition of Charge Generation Layer Coating Liquid Bisazo pigment having the following structural formula (M): 2.5 parts by weight Polyvinyl butyral (XYHL manufactured by UCC (Union Carbide Corporation)): 0.5 parts by weight Cyclohexanone: 200 parts by weight Methyl ethyl ketone: 80 parts by weight (M)

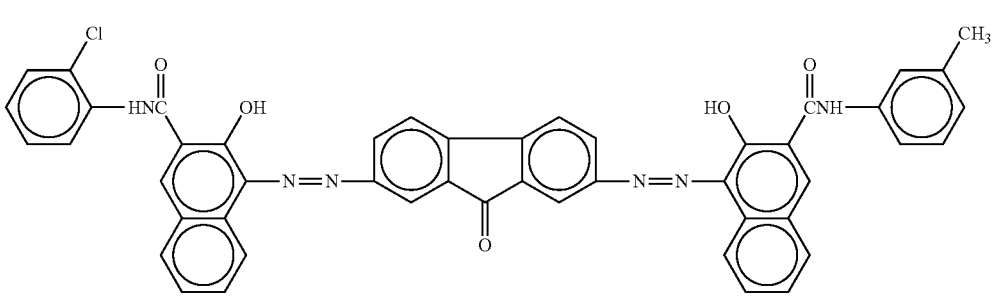

Composition of Charge Transport Layer Coating Liquid

Bisphenol Z polycarbonate (PANLITE TS-2050 available from TEIJIN LIMITED): 10 parts by weight Charge transport material having the following structural formula (N): 7 parts by weight Tetrahydrofuran: 100 parts by weight 1% Tetrahydrofuran solution of silicone oil (KF50-100CS available from Shin-Etsu Chemical Co., Ltd.): 1 part by weight (N)

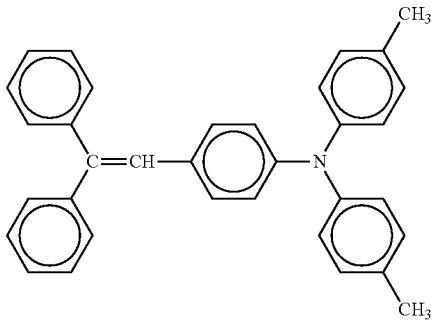

Next, a surface layer coating liquid having the following composition was applied onto the above-prepared laminate composed of the conductive substrate, undercoat layer, charge generation layer, and charge transport layer. Specifically, a surface layer having a thickness of 2 μm was formed by a spray coating method using the following surface layer coating liquid, followed by heating at 150 degrees C. for 30 minutes. Thus, an electrophotographic photoconductor 1 was prepared.

Composition of Surface Layer Coating Liquid

Polyarylate resin having the following structural formula (D): 40 parts by weight Methylol compound having the following structural formula (A): 35 parts by weight Aluminum oxide (SUMICORUNDUM AA03 available from Sumitomo Chemical Co., Ltd., having a volume average particle diameter of 300 nm): 25 parts by weight Surfactant (BYK-P104 available from BYK Japan KK): 0.5 parts by weight Tetrahydrofuran: 1,330 parts by weight Cyclohexanone: 570 parts by weight (D)

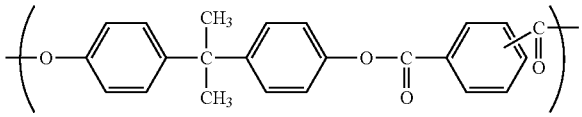

(A)

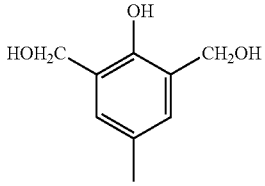

Production of Electrophotographic Photoconductor 2

An electrophotographic photoconductor was prepared in the same manner as the electrophotographic photoconductor 1 except that the surface layer coating liquid was replaced with another surface layer coating liquid described below and the film thickness of the surface layer was changed to 5 μm.

Composition of Surface Layer Coating Liquid

Polyarylate resin having the following structural formula (D): 31.5 parts by weight Methylol compound having the following structural formula (B): 6 parts by weight Charge transport material having the following structural formula (N): 37.5 parts by weight Aluminum oxide (SUMICORUNDUM AA03 available from Sumitomo Chemical Co., Ltd., having a volume average particle diameter of 300 nm): 25 parts by weight Surfactant (BYK-P104 available from BYK Japan KK): 0.5 parts by weight Tetrahydrofuran: 1,330 parts by weight Cyclohexanone: 570 parts by weight (B)

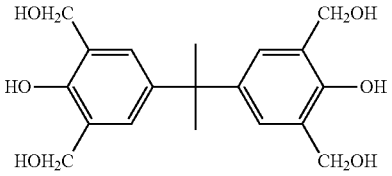

Production of Electrophotographic Photoconductor 3

An electrophotographic photoconductor was prepared in the same manner as the electrophotographic photoconductor 1 except that the surface layer coating liquid was replaced with another surface layer coating liquid described below and the film thickness of the surface layer was changed to 5 μm.

Composition of Surface Layer Coating Liquid

Polyarylate resin having the following structural formula (D): 31.5 parts by weight Methylol compound having the following structural formula (Q): 6.0 parts by weight Charge transport material having the following structural formula (N): 37.5 parts by weight Aluminum oxide (SUMICORUNDUM AA03 available from Sumitomo Chemical Co., Ltd., having a volume average particle diameter of 300 nm): 25 parts by weight Surfactant (BYK-P104 available from BYK Japan KK): 0.5 parts by weight Tetrahydrofuran: 1,330 parts by weight Cyclohexanone: 570 parts by weight (Q)

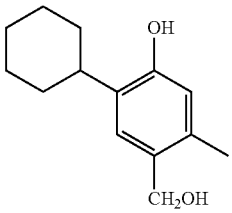

The Martens hardness of each photoconductor was determined as follows.

Martens Hardness

Using an evaluation device FISHERSCOPE H-100 (available from Fischer Instruments K.K.), a Vickers square pyramid diamond indenter having an angle of 136° between the opposite faces was pressed against the surface of the photoconductor under the following conditions.

Final load continuously applied to the indenter: 6 mN

Time (holding time) for holding a state in which the final load of 6 mN is applied to the indenter: 0.1 seconds Measurement environment: 23 degrees C., 55% RH Measurement points: 20 points, the distance between the centers being 10 mm or more The Martens hardness value (HMk) was determined by the following equation using the average value of the indentation depth of the indenter when the final load of 6 mN was applied to the indenter. In the following equation, HMk represents a universal hardness value, $F_f$ represents a final load, and $S_f$ represents a surface area of a portion where the indenter is pressed when the final load is applied. In addition, $h_f$ represents an indentation depth (mm) of the indenter when the final load is applied.

$$HMk = \frac{F_f[\mathrm{N}]}{S_f[\mathrm{mm}^2]} = \frac{6\times10^{-3}}{26.43\times(h_f\times10^{-3})^2}$$

An image was formed with the above-prepared two-component developer, and the following performance evaluations were performed.

Low-temperature Fixability

A copy test was performed using a copier MF2200 (manufactured by Ricoh Co., Ltd.) employing a TEFLON (registered trademark) roller as the fixing roller and the fixing unit of which had been modified, and a paper TYPE 6200 (manufactured by Ricoh Co., Ltd.).

In the test, the cold offset temperature (lower-limit fixable temperature) was determined by varying the fixing temperature and evaluated based on the following evaluation criteria.

The lower-limit fixable temperature was evaluated while setting the sheet feed linear velocity to 120 to 150 mm/sec, the surface pressure to 1.2 kgf/cm$^2$, and the nip width to 3 mm.

Evaluation Criteria

A+: The lower-limit fixable temperature is lower than 110 degrees C.

A: The lower-limit fixable temperature is 110 degrees C. or higher and lower than 125 degrees C.

C: The lower-limit fixable temperature is 125 degrees C. or higher.

Durability

In a high-temperature high-humidity environment (27 degrees C., 80% RH), an image having an image area ratio of 5% was copied on 500,000 sheets using a modified machine of a digital full-color multifunction peripheral IMAGIO NEO 271 manufactured by Ricoh Co., Ltd. Next, a solid image was printed on an entire sheet, and the image was visually observed to evaluate durability.

A+: No streak-like color omission occurs.

A: Streak-like thin color omission slightly occurs (less than 5% of the solid image portion).

B: Streak-like thin color omission occurs (5% or more and less than 10% of the solid image portion).

C: Streak-like thin color omission significantly occurs (10% or more of the solid image portion) or streak-like thick color omission occurs.

Filming on Photoconductor (OPC)

In a hygrothermal environment with a temperature of 10 degrees C. and a relative humidity of 15%, each toner and a photoconductor were evaluated using a modified machine of IMAGIO NEO 271 manufactured by Ricoh Co., Ltd., a part of which had been tuned, as a test machine. The printing speed in the evaluation was a high speed (45 sheets/min/A4).

After 10,000 sheets of a 5% image area density chart were printed, 5,000 sheets of a 1% image area density chart were printed, and further 10,000 sheets of a 10% image area density chart were printed. After that, the amount of components adhered to the photoconductor was evaluated by visual observation according to the following evaluation criteria.

Evaluation Criteria

A: No adhesion. Good.

B: Cloudy streaks are confirmed.

C: Cloudy areas are large.

Ranks A and B have no problem in practical use in terms of filming resistance.

Wear Rate of Photoconductor

In an environment with a temperature of 40 degrees C. and a relative humidity of 90%, a durability test in which 100,000 sheets of a 5% image area ratio chart were continuously printed was performed using a modified machine of IMAGIO NEO 271 manufactured by Ricoh Co., Ltd. using each toner and a photoconductor. After the durability test, a decrease in film thickness was measured by an eddy current film thickness meter (FISCHERSCOPE MMS available from Fischer Instruments K.K.).

Evaluation Criteria

A+: Wear amount is less than 1.0 μm.

A: Wear amount is 1.0 μm or more and less than 1.5 μm.

C: Wear amount is 1.5 μm or more.

Scratch on Photoconductor

In an environment with a temperature of 40 degrees C. and a relative humidity of 90%, a durability test in which 100,000 sheets of a 5% image area ratio chart were continuously printed was performed using a modified machine of IMAGIO NEO 271 manufactured by Ricoh Co., Ltd. using each toner and a photoconductor. After the durability test, scratches made on the surface of the photoconductor were observed with a laser microscope (VK-8500 manufactured by Keyence Corporation).

A+: No noticeable scratch was observed.

A: Scratch was observed with the microscope but did not appear in the image.

C: Large and deep scratch was observed and appeared in the image.

The results are presented in Tables 2-1, 2-2, and 3.

TABLE 2-1

| | | | Example 1 | Example 2 | Example 3 | Example4 | Example 5 | Example6 | Example 7 |
|---|---|---|---|---|---|---|---|---|---|
| Toner No. | | | Toner 1 | Toner 2 | Toner 3 | Toner 4 | Toner 5 | Toner 6 | Toner 7 |
| Ester Elongation Method Oil Phase Preparation Parts | Amorphous Polyester Resin-Pigment-Wax Dispersion Liquid A1 | parts | 500 | | 500 | 500 | 500 | 500 | 500 |
| | Amorphous Polyester Resin-Pigment-Wax Dispersion Liquid A2 | parts | | 664 | | | | | |
| | Polyester Prepolymer A | parts | 96 | | 96 | 96 | 96 | 96 | 48 |
| | Polyester Prepolymer B | parts | | 109 | | | | | 48 |
| | Crystalline Polyester Dispersion Liquid A | parts | 150 | 74 | 150 | 150 | 150 | 150 | 150 |
| | Ketimine Compound | parts | 4.0 | 4.6 | 4.0 | 4.0 | 4.0 | 4.0 | 4.0 |
| Emulsion Polymerization Method Emulsion Aggregation Method Dispersion Liquid Parts | Styrene Acrylic Resin-Wax Dispersion Liquid A | parts | | | | | | | |
| | Amorphous Polyester Resin Dispersion Liquid B | parts | | | | | | | |
| | Crystalline Polyester Resin Dispersion Liquid B | parts | | | | | | | |
| | Pigment Dispersion Liquid | parts | | | | | | | |
| | Wax Dispersion Liquid | parts | | | | | | | |
| External Additives Parts | Toner Base Particles | parts | 100 | 100 | 100 | 100 | 100 | 100 | 100 |
| | Silica UFP-35 | parts | 2 | 2 | 2 | 2 | 2 | 2 | 2 |
| | Silica RX-50 | parts | 1.6 | 1.6 | 1.6 | 1.6 | 1.6 | 1.6 | 1.6 |
| | Particles A Composed Mainly of Strontium Titanate | parts | 0.6 | 0.6 | | | | | 0.6 |
| | Particles B Composed Mainly of Strontium Titanate | parts | | | | | | | |
| | Particles C Composed Mainly of Strontium Titanate | parts | | 0.6 | | | | | |
| | Particles D Composed Mainly of Strontium Titanate | parts | | | 0.6 | | | | |
| | Particles E Composed Mainly of Strontium Titanate | parts | | | | | 0.6 | | |
| | Particles F Composed Mainly of Strontium Titanate | parts | | | | | | 0.6 | |
| | Particles G Composed Mainly of StrontiumTitanate | parts | | | | | | | |
| | Titanium Oxide ST-550 | parts | | | | | | | |
| | Alumina | parts | | | | | | | |
| Toner Properties | Number Average Particle Diameter Dn | μm | 4.5 | 4.6 | 4.5 | 4.5 | 4.5 | 4.5 | 4.6 |
| | Average Value X of Amount of Deformation by Micro-indentation | μm | 0.61 | 0.64 | 0.60 | 0.59 | 0.60 | 0.60 | 0.73 |
| | X/Dn | — | 0.135 | 0.139 | 0.134 | 0.132 | 0.133 | 0.133 | 0.158 |
| | External Additive Covering Ratio | % | 37 | 37 | 36 | 37 | 36 | 38 | 37 |
| | Average Value of Smallest Radius R | nm | 11.9 | 11.8 | 11.2 | 11.4 | 11.8 | 11.2 | 12.1 |
| | Frequency of Particles Composed Mainly of Strontium Titanate Satisfying 11 nm ≤R ≤13 nm | % | 65 | 66 | 53 | 47 | 48 | 51 | 62 |

| | | | Photoconductor No. | | | | | | |
|---|---|---|---|---|---|---|---|---|---|
| | | | Photo-conductor 1 | Photo-conductor 1 | Photo-conductor 1 | Photo-conductor 1 | Photo-conductor 1 | Photo-conductor 1 | Photo-conductor 1 |
| Surface Layer Coating Liquid Parts | Polyarylatc Resin D | parts | 40 | 40 | 40 | 40 | 40 | 40 | 40 |
| | Methylol Compound A | parts | 35 | 35 | 35 | 35 | 35 | 35 | 35 |
| | Methylol Compound B | parts | | | | | | | |
| | Methylol Compound Q | parts | | | | | | | |
| | Charge Transport Material N | parts | | | | | | | |
| | Aluminum Oxide | parts | 25 | 25 | 25 | 25 | 25 | 25 | 25 |
| | Surfactant | parts | 0.5 | 0.5 | 0.5 | 0.5 | 0.5 | 0.5 | 0.5 |
| | Tetrahydrofuran | parts | 1330 | 1330 | 1330 | 1330 | 1330 | 1330 | 1330 |
| | Cyclohexanone | parts | 570 | 570 | 570 | 570 | 570 | 570 | 570 |
| Photoconductor Properties | Martens Hardness | $N/mm^2$ | 188 | 188 | 188 | 188 | 188 | 188 | 188 |
| Quality | Low-temperature Fixability | | A | A | A | A | A | A | A+ |
| | Durability | | A | A | A | A | A | A | A |
| | OPC Filming | | A | A | A | A | A | A | A |
| | OPC Wear Rate | | A | A | A | A | A | A | A |
| | OPC Scratch | | A | A | A | A | A | A | A |

TABLE 2-2

| | | | Example 8 | Example 9 | Example 10 | Example 11 | Example 12 | Example 13 |
|---|---|---|---|---|---|---|---|---|
| Toner No. | | | Toner 8 | Toner 9 | Toner 9 | Toner 10 | Toner 11 | Toner 12 |
| Ester Elongation Method Oil Phase Preparation Parts | Amorphous Polyester Resin-Pigment-Wax Dispersion Liquid A1 | parts | 500 | 500 | 500 | 500 | 500 | 500 |
| | Amorphous Polyester Resin-Pigment-Wax Dispersion Liquid A2 | parts | | | | | | |
| | Polyester Prepolymer A | parts | 96 | 96 | 96 | 64 | 48 | 48 |
| | Polyester Prepolymer B | parts | | | | 32 | 48 | 48 |
| | Crystalline Polyester Dispersion Liquid A | parts | 150 | 150 | 150 | 150 | 150 | 150 |
| | Ketimine Compound | parts | 4.0 | 4.0 | 4.0 | 4.0 | 4.0 | 4.0 |
| Emulsion Polymerization Method Emulsion Aggregation Method Dispersion Liquid Parts | Styrene Acrylic Resin-Wax Dispersion Liquid A | parts | | | | | | |
| | Amorphous Polyester Resin Dispersion Liquid B | parts | | | | | | |
| | Crystalline Polyester Resin Dispersion Liquid B | parts | | | | | | |
| | Pigment Dispersion Liquid | parts | | | | | | |
| | Wax Dispersion Liquid | parts | | | | | | |
| External Additives Parts | Toner Base Particles | parts | 100 | 100 | 100 | 100 | 100 | 100 |
| | Silica UFP-35 | parts | 2 | 2.4 | 2.4 | 2.4 | 2.2 | 2.2 |
| | Silica RX-50 | parts | 2 | 2.6 | 2.6 | 2.6 | 2.4 | 2.4 |
| | Particles A Composed Mainly of Strontium Titanate | parts | 0.6 | 0.6 | 0.6 | 0.6 | 0.6 | |
| | Particles B Composed Mainly of Strontium Titanate | parts | | | | | | 0.6 |
| | Particles C Composed Mainly of Strontium Titanate | parts | | | | | | |
| | Particles D Composed Mainly of Strontium Titanate | parts | | | | | | |
| | Particles E Composed Mainly of Strontium Titanate | parts | | | | | | |
| | Particles F Composed Mainly of Strontium Titanate | parts | | | | | | |
| | Particles G Composed Mainly of Strontium Titanate | parts | | | | | | |
| | Titanium Oxide ST-550 | parts | | | | | | |
| | Alumina | parts | | | | | | |
| Toner Properties | Number Average Particle Diameter Dn | μm | 4.5 | 4.5 | 4.5 | 4.7 | 4.6 | 4.6 |
| | Average Value X of Amount of Deformation by Micro-indentation | μm | 0.60 | 0.59 | 0.59 | 0.71 | 0.73 | 0.73 |
| | X/Dn | — | 0.134 | 0.132 | 0.132 | 0.151 | 0.158 | 0.158 |
| | External Additive Covering Ratio | % | 44 | 67 | 67 | 68 | 58 | 58 |
| | Average Value of Smallest Radius R | nm | 12.1 | 12.0 | 12.0 | 12.8 | 11.4 | 12.8 |
| | Frequency of Particles Composed Mainly of Strontium Titanate Satisfying 11 nm ≤R ≤13 nm | % | 65 | 62 | 62 | 65 | 63 | 74 |

| | | | Photoconductor No. | | | | | |
|---|---|---|---|---|---|---|---|---|
| | | | Photo-conductor 1 | Photo-conductor 1 | Photo-conductor 2 | Photo-conductor 2 | Photo-conductor 2 | Photo-conductor 2 |
| Surface Layer Coating Liquid Parts | Polyarylate Resin D | parts | 40 | 40 | 31.5 | 31.5 | 31.5 | 31.5 |
| | Methylol Compound A | parts | 35 | 35 | | | | |
| | Methylol Compound B | parts | | | 6 | 6 | 6 | 6 |
| | Methylol Compound Q | parts | | | | | | |
| | Charge Transport Material N | parts | | | 37.5 | 37.5 | 37.5 | 37.5 |
| | Aluminum Oxide | parts | 25 | 25 | 25 | 25 | 25 | 25 |
| | Surfactant | parts | 0.5 | 0.5 | 0.5 | 0.5 | 0.5 | 0.5 |
| | Tetrahydrofuran | parts | 1330 | 1330 | 1330 | 1330 | 1330 | 1330 |
| | Cyclohexanone | parts | 570 | 570 | 570 | 570 | 570 | 570 |
| Photoconductor Properties | Martens Hardness | $N/mm^2$ | 188 | 188 | 211 | 211 | 211 | 211 |
| Quality | Low-temperature Fixability | | A | A | A | A+ | A+ | A+ |
| | Durability | | A+ | A+ | A+ | A+ | A+ | A+ |
| | OPC Filming | | A | A | A | A | A | A |
| | OPC Wear Rate | | A | A | A | A | A | A+ |
| | OPC Scratch | | A | A | A+ | A+ | A+ | A+ |

TABLE 3

| | | | Comp Example 1 | Comp Example 2 | Comp Example 3 | Comp Example 4 | Comp Example 5 | Comp Example 6 | Comp Example 7 | Comp Example 8 | Comp Example 9 |
|---|---|---|---|---|---|---|---|---|---|---|---|
| Toner No. | | | Toner 1 | Toner 13 | Toner 14 | Toner 15 | Toner 16 | Toner 17 | Toner 18 | Toner 19 | Toner 20 |
| Ester Elongation Method Oil Phase Preparation Parts | Amorphous Polyester Resin-Pigment-Wax Dispersion Liquid A1 | parts | 500 | 500 | 500 | 500 | 500 | | 500 | | |
| | Amorphous Polyester Resin-Pigment-Wax Dispersion Liquid A2 | parts | | | | | | 664 | | | |
| | Polyester Prepolymer A | parts | 96 | 96 | 96 | 96 | 96 | 109 | | | |
| | Polyester Prepolymer B | Parts | 96 | | | | | | | | |
| | Crystalline Polyester Disperion Liquid A | Parts | 150 | 150 | 150 | 150 | 150 | 74 | 150 | | |
| | Ketimine Compound | Parts | 4.0 | 4.0 | 4.0 | 4.0 | 4.0 | 4.6 | 4.0 | | |
| Emulsion Polymerization Method Emulsion Aggregation Method Dispersion Liquid Parts | Styrene Acrylic Resin-Wax Dispersion Liquid A | Parts | | | | | | | | 300 | |
| | Amorphous Polyester Resin Dispersion Liquid B | parts | | | | | | | | | 250 |
| | Crystalline Polyester Resin Dispersion Liquid B | parts | | | | | | | | | 47 |
| | Pigment Dispersion Liquid | parts | | | | | | | | 24.5 | 26 |
| | Wax Dispersion Liquid | parts | | | | | | | | | 18 |
| External Additives Parts | Toner Base Particles | parts | 100 | 100 | 100 | 100 | 100 | 100 | 100 | 100 | 100 |
| | Silica UFP-35 | parts | 2 | 2 | 2 | 2 | 2 | 2 | 2 | | |
| | Silica RX-50 | parts | 1.6 | 1.6 | 1.6 | 1.6 | 1.6 | 1.6 | 1.6 | 1 | 1 |
| | Particles A Composed Mainly of Strontium Titanate | parts | 0.6 | | | | | 0.6 | 0.6 | 0.6 | 0.6 |
| | Particles B Composed Mainly of Strontium Titanate | parts | | | | | | | | | |
| | Particles C Composed Mainly of Strontium Titanate | parts | | | | | | | | | |
| | Particles D Composed Mainly of Strontium Titanate | parts | | | | | | | | | |
| | Particles E Composed Mainly of Strontium Titanate | parts | | | | | | | | | |
| | Particles F Composed Mainly of Strontium Titanate | parts | | | | | | | | | |

TABLE 3-continued

| | | | Comp Example 1 | Comp Example 2 | Comp Example 3 | Comp Example 4 | Comp Example 5 | Comp Example 6 | Comp Example 7 | Comp Example 8 | Comp Example 9 |
|---|---|---|---|---|---|---|---|---|---|---|---|
| | Particles G Composed Mainly of Strontium Titanate | parts | | | 0.6 | | | | | | |
| | Titanium Oxide ST-550 | parts | | | | 0.6 | | | | | |
| | Alumina | parts | | | | | 0.6 | | | | |
| Toner Properties | Number Average Particle Diameter Dn | μm | 4.5 | 4.5 | 4.5 | 4.5 | 4.5 | 4.7 | 4.7 | 4.7 | 4.7 |
| | Average Value X of Amount of Deformation by Micio-indentation | μm | 0.61 | 0.61 | 0.60 | 0.60 | 0.59 | 0.59 | 0.78 | 0.79 | 0.77 |
| | X/Dn | — | 0.135 | 0.136 | 0.134 | 0.134 | 0.132 | 0.126 | 0.165 | 0.169 | 0.164 |
| | External Additive Covering Ratio | % | 36 | 29 | 35 | 37 | 35 | 34 | 37 | 18 | 17 |
| | Average Value of Smallest Radius R | nm | 12.0 | — | 10.5 | 10.7 | 14.3 | 11.3 | 12.1 | 12 | 11.8 |
| | Frequency of Particles Composed Mainly of strontium Titanate Satisfying 11 nm ≤R ≤13 nm | % | 63 | — | 34 | 53 | 28 | 64 | 65 | 64 | 65 |

| | | | Photoconductor No. | | | | | | | | |
|---|---|---|---|---|---|---|---|---|---|---|---|
| | | | Photo-conductor 3 | Photoconductor 1 | Photoconductor 1 | Photoconductor 1 | Photoconductor 1 | Photoconductor 1 | Photoconductor 1 | Photoconductor 1 | Photoconductor 1 |
| Surface Layer Coating Liquid Parts | Polyarylate Resin D | parts | 31.5 | 40 | 40 | 40 | 40 | 40 | 40 | 40 | 40 |
| | Methylol Compound A | parts | | 35 | 35 | 35 | 35 | 35 | 35 | 35 | 35 |
| | Methylol Compound B | parts | | | | | | | | | |
| | Methylol Compound Q | parts | 6 | | | | | | | | |
| | Charge Transport Material N | parts | 37.5 | | | | | | | | |
| | Aluminum Oxide | parts | 25 | 25 | 25 | 25 | 25 | 25 | 25 | 25 | 25 |
| | Surfactant | parts | 0.5 | 0.5 | 0.5 | 0.5 | 0.5 | 0.5 | 0.5 | 0.5 | 0.5 |
| | Tetrahydrofuran | parts | 1330 | 1330 | 1330 | 1330 | 1330 | 1330 | 1330 | 1330 | 1330 |
| | Cyclohexanone | parts | 570 | 570 | 570 | 570 | 570 | 570 | 570 | 570 | 570 |
| Photo-conductor Properties | Martens Hardness | N/mm$^2$ | 182 | 188 | 188 | 188 | 188 | 188 | 188 | 188 | 188 |
| Quality | Low-temperature Fixability | | A | A | A | A | A | C | A+ | A | A+ |
| | Durability | | A | A | A | A | A | A+ | C | C | C |
| | OPC Filming | | A | C | A | C. | A | A | A | A | A |
| | OPC Wear Rate | | C | C | A | A | C | A | A | A | A |
| | OPC Scratch | | C | A | C | A | A | A | A | A+ | A+ |

It is clear from the results presented in Tables 2-1, 2-2, and 3 that each example achieved satisfactory levels in the evaluations of low-temperature fixability, durability, filming resistance on the photoconductor, wear rate of the photoconductor, and scratches on the photoconductor.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus,. comprising:

an image bearer;

a charger configured to charge a surface of the image bearer;

an irradiator configured to write an electrostatic latent image on the charged surface of the image bearer;

a developing device containing a toner, the developing device configured to visualize the electrostatic latent image formed on the surface of the image bearer with the toner to form a toner image;

a transfer device configured to transfer the toner image from the surface of the image bearer onto a transfer medium, wherein the image bearer has a Martens hardness of from 185 to 250 $N/mm^2$, wherein the toner satisfies a relation $0.13 \leq X/Dn \leq 0.16$, where X represents an average value of an amount of deformation of the toner by micro-indentation when a load reaches $3.00 \times 10^{-4}$ N at a loading rate of $3.0 \times 10^{-5}$N/sec under an environment of 32 degrees C. and 40%RH, and Dn represents a number average particle diameter of the toner, wherein the toner contains an external additive comprising:

silica particles; and particles composed mainly of strontium titanate, the particles composed mainly of strontium titanate further containing a third element M selected from the group consisting of La, Mg, Ca, Sn, and Si.

2. The image forming apparatus according to claim 1, wherein a covering ratio of the toner with the external additive is from 40% to 70%.

3. The image forming apparatus according to claim 1, wherein the image bearer has a Martens hardness of from 200 to 250 $N/mm^2$.

4. The image forming apparatus according to claim 1, wherein the toner satisfies a relation $0.15 \leq X/Dn \leq 0.16$, and a covering ratio of the toner with the external additive is from 55% to 70%.

5. The image forming apparatus according to claim 1, wherein the particles composed mainly of strontium titanate have an average particle diameter of from 30 nm or more, wherein, in a projected image of one particle of the particles, when an arbitrary point on a contour of the particle is defined as a reference point A, another point on the contour of the particle linearly distant from the reference point A for 15 nm in one direction is defined as a point B, another point on the contour of the particle linearly distant from the reference point A for 15 nm in another direction is defined as a point C, and a smallest radius of a circumscribed circle of a triangle formed by the points A, B and C is defined as R, an average value of the smallest radius R is from 11 to 13 nm.

6. The image forming apparatus according to claim 5, wherein, among the particles composed mainly of strontium titanate, those satisfying a condition in which the average value of the smallest radius R is from 11 to 13 nm account for 70% by mass or more of all the particles.

7. The image forming apparatus according to claim 1, wherein the image bearer has a surface layer containing a filler having a volume average particle diameter of from 10 to 500 nm.

8. The image forming apparatus according to claim 1, wherein the toner contains a binder resin comprising an amorphous polyester resin, and a proportion of the amorphous polyester resin in the toner is 50% by mass or more.

9. The image forming apparatus according to claim 1, wherein surfaces of the particles composed mainly of strontium titanate are covered with an organic compound.

10. An image forming method,. comprising:

charging a surface of an image bearer;

writing an electrostatic latent image on the charged surface of the image bearer;

developing the electrostatic latent image formed on the surface of the image bearer with a toner to form a toner image; and transferring the toner image from the surface of the image bearer onto a transfer medium, wherein the image bearer has a Martens hardness of from 185 to 250 $N/mm^2$, wherein the toner satisfies a relation $0.13 \leq X/Dn \leq 0.16$, where X represents an average value of an amount of deformation of the toner by micro-indentation when a load reaches $3.00 \times 10^{-4}$N at a loading rate of $3.0 \times 10^{-5}$N/sec under an environment of 32 degrees C. and 40%RH, and Dn represents a number average particle diameter of the toner, wherein the toner contains an external additive comprising:

silica particles; and particles composed mainly of strontium titanate, the particles composed mainly of strontium titanate further containing a third element M selected from the group consisting of La, Mg, Ca, Sn, and Si.

* * * * *